United States Patent [19]

Barnes et al.

[11] Patent Number: 4,961,581

[45] Date of Patent: Oct. 9, 1990

[54] APPARATUS FOR PLAYING A GAME

[75] Inventors: David Barnes; Alick M. Sharp, both of Wilberfoss, England

[73] Assignee: Rotation Limited, England

[21] Appl. No.: 256,026

[22] Filed: Oct. 11, 1988

[30] Foreign Application Priority Data

Oct. 23, 1987 [GB] United Kingdom ..... 8724931

[51] Int. Cl.[5] ..... A63F 3/00

[52] U.S. Cl. ..... 273/236; 273/280; 273/281; 273/287; 273/143 R

[58] Field of Search ..... 273/281, 280, 287, 143 D, 273/236, 265, 256

[56] References Cited

U.S. PATENT DOCUMENTS

| | | | |
|---|---|---|---|
| 3,163,423 | 12/1964 | Jackson | 273/256 |
| 3,733,076 | 5/1973 | Ohki | 273/143 R |
| 4,134,592 | 1/1979 | Pullman | 273/281 |
| 4,188,036 | 2/1980 | Jones-Fenleigh | 273/265 |
| 4,705,276 | 11/1987 | Kastle et al. | 273/280 |
| 4,743,029 | 5/1988 | Consolatore et al. | 273/281 |

FOREIGN PATENT DOCUMENTS

| | | | |
|---|---|---|---|
| 2206173 | 2/1971 | Fed. Rep. of Germany | 273/143 R |
| 289729 | 12/1950 | France | 273/143 R |
| 1338212 | 1/1972 | United Kingdom | 273/143 R |
| 2130413 | 10/1983 | United Kingdom | 273/143 B |
| 2157047 | 4/1984 | United Kingdom | 273/143 R |

OTHER PUBLICATIONS

European Search Report of EP88,30,9474 Completed 12/3/90.

*Primary Examiner*—Benjamin Layno

*Attorney, Agent, or Firm*—Diller, Ramik & Wight

[57] ABSTRACT

A board game having a rectangular support for carrying arrays of images. Each image has a set of six manually variable rotatable drum indicators, each set, one for each player, being located are at each of the peripheral sides of the support. Each drum bears a number of peripheral images. Only one of which is visible at any one time. The number selected by throwing dice direct players to rotate the corresponding drums. An objective of the game is to display common numbers through a player's set of arrays.

19 Claims, 6 Drawing Sheets

APPARATUS FOR PLAYING A GAME

BACKGROUND OF THE INVENTION

This invention relates to apparatus for playing a game for one or more players and to games played with the apparatus. The apparatus can be provided in various forms but is preferably, although not essentially, in the form of a board game, that is a game in which the play takes place on a substantially horizontal surface.

SUMMARY OF THE INVENTION

According to the present invention apparatus for playing a game comprises a support carrying two or more arrays of images, each array comprising a set of variable indicators, each of which has a number of images arranged in a predetermined sequence, and one of which is displayed at a time, and means for a player to vary each indicator to alter the displayed image.

In one preferred embodiment each variable indicator comprises a rotatable wheel or drum provided with a sequence of images about its periphery and means for indicating one displayed image. Thus, the images can be any form of indicia such as letters, numbers or symbols or different colours, or other devices.

Moreover, the indicia can be provided in braille, that is various symbols represented by impressions or relief so that they can be recognized by a blind player.

The variable indicators can be carried in a casing provided with windows which indicate the displayed image for each indicator.

With this arrangement part of the periphery of each wheel or drum projects through its associated window to allow manual manipulation thereof.

In one convenient form of the apparatus the arrays of images are carried on horizontally spaced apart opposite sides of the support so that the players can sit each side of the apparatus and face each other.

In an alternative arrangement three or more arrays are provided arranged around the periphery of the support.

If desired and in order to provide a more difficult game, two or more arrays can be provided on an upper side of said support and two or more arrays on a lower side thereof, thus enabling the game to be played from either side of the support.

With this construction each indicator can have two windows, one on the upper side and one on the lower side of the casing so that the wheel or drum can be used to provide an image on both sides of the casing.

"Freeze" means for indicating that an image, when displayed, must not be altered and must be regarded as frozen in position can be provided and may be in the form of a removable peg which can be manually moved from a non-use position to a location adjacent the variable indicator which is to be "frozen". The use of such freeze means will become apparent from inspection of the Rules set forth herein.

In an alternative form of the apparatus the arrays can be provided by for example liquid crystal displays, LCD or light emitting diodes (LED), the variable indicators being manually operable by control means which operate a memory to provide the images at the LCD or LED.

With this arrangement only one of the images held in the memory is provided in the LCD or LED at a time and the control means may also be arranged so as to "freeze" the output of the memory on a predecided image or indicator means could be arranged associated with that image display to indicate that it is frozen.

In any case, illuminating means can be provided adjacent the variable indicators to allow the game to be played in a low light.

Means can be provided to allow the support to be rotated about a base so that the arrays can be moved from one player to another by rotation of the support. The reason for this feature will become apparent from inspection of the Rules.

Preferably a random indicator is provided and this may be in the form of one or more dice, a top or tops, a card or cards, or other devices.

When the apparatus includes a liquid crystal display the random indicator can be electrically operated.

Preferably the apparatus also includes a master random indicator and which can have a number of options which are at least one less than the number of arrays of images. Thus, if there were four arrays then the master random indicator would be provided with three options. Thus, if the master random indicator was a six sided dice then the digits 1, 2, 3 could be marked twice on its six sides.

In an alternative arrangement each option on the master random indicator can be arranged to indicate two more instructions for play, thus one side, for example, of a dice could not only include a digit, but also a background colour or an arrow pointing in a particular direction such as clockwise or anti-clockwise. Once again the significance of this master random indicator will become apparent from inspection of the Rules.

If desired means can be provided for optionally concealing the images of the arrays so that at least part of the array of one player is not visible to another thus enabling a "secret" game to be played by each player until the hand provided by the array is revealed.

In order to provide a more difficult game each array may comprise two or more sets of variable indicators and with this arrangement the sets of variable indicators can be interconnected so that variation of an indicator in one set to alter the displayed image alters the display image in another interconnected set.

The apparatus preferably includes a set of Rules for playing various games.

The invention also includes a game for one or more players with apparatus as set forth above in accordance with the set of Rules.

The invention can be performed in many ways and various embodiments will now be described by way of example and with reference to the accompanying drawings in which:

DESCRIPTION OF THE PREFERRED EMBODIMENTS

The game can be played by one or more players although any number of players can be accommodated, physical size and complexity will eventually prohibit the maximum number. In the format shown in FIG. 1 up to four players can be accommodated. The players may play individually or as teams.

The number of different games which may be played using the game apparatus have yet to be fully determined but a larger number of different games have already been envisaged. Because of the way in which the game is played, a player having to leave before a game is complete does not necessarily bring it to a stop. Equally, as a new player wishes to join the game he may do so without any disruption in the flow of the game, provided the maximum number of players are not already playing.

Figure 1:
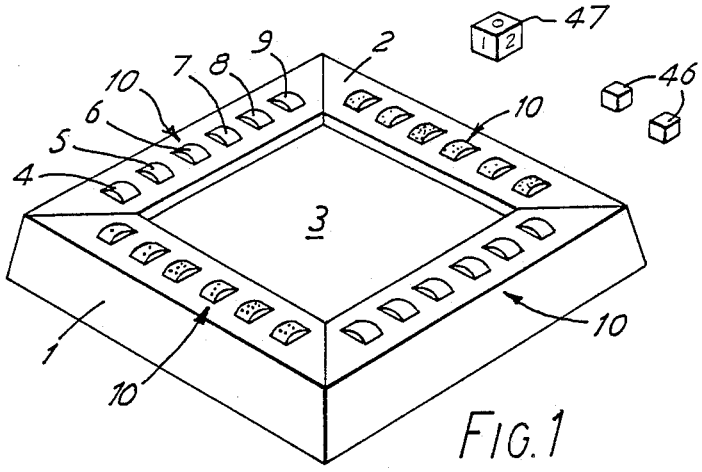
FIG. 1 is a diagrammatic view of apparatus for playing a game according to the present invention.

As shown in FIG. 1 the apparatus comprises a support in the form of a casing 1, the upper surface of which is dished to provide an outer rim 2 and an inner flat surface 3. Each side of the square rim is provided with an array of images, each array comprising a set of variable indicators indicated by reference numerals 4–9, the complete set of images is indicated by reference numeral 10. The images on the indicators can be in any convenient form, for example letters, numbers, colours or any other characteristics or symbols.

Figure 3:
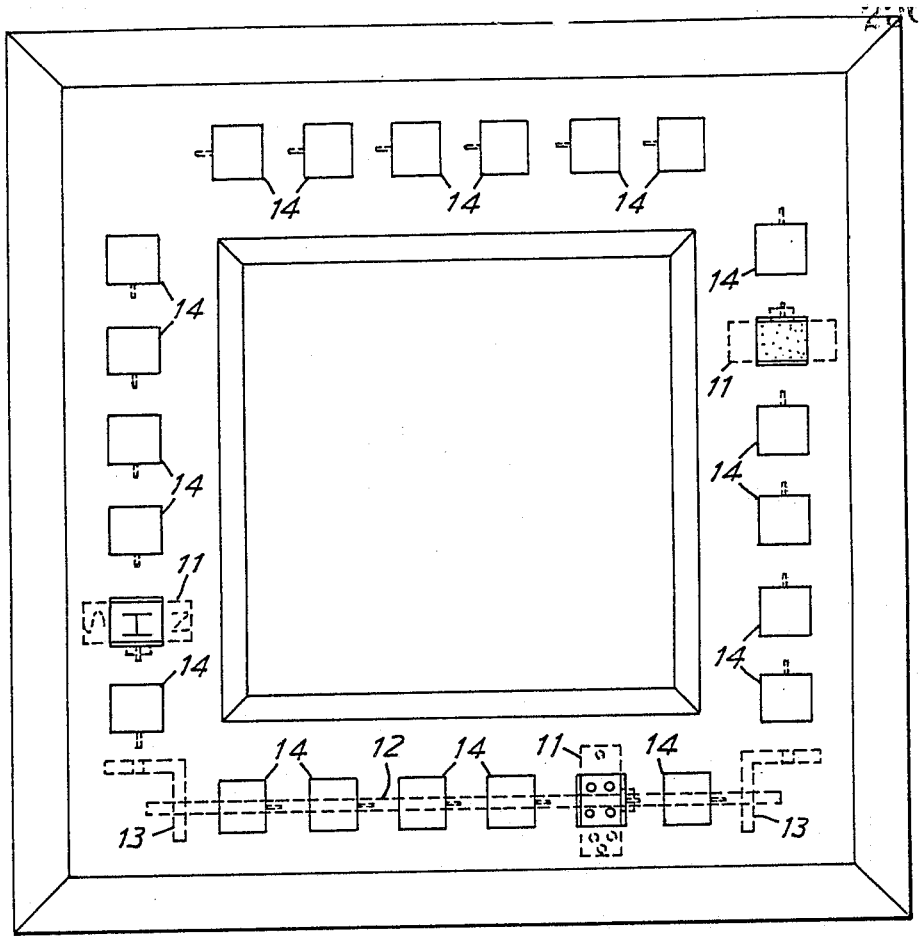
FIG. 3 is a bottom plan view of the support shown in FIG. 2.
Figure 5:
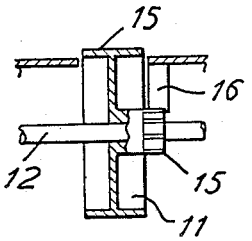
FIG. 5 is a detailed view of the means for mounting one of the variable indicators.
Figure 6:
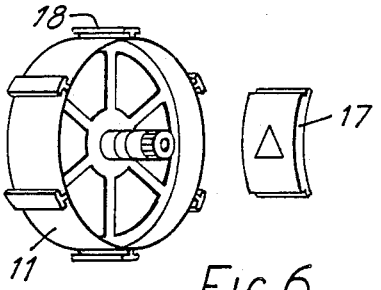
FIG. 6 is an isometric view of one of the indicators showing how image carriers can be applied.
Figure 7:
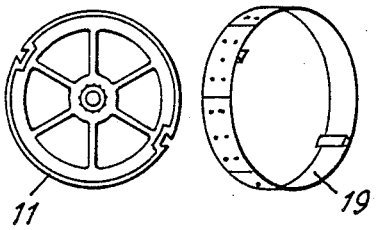
FIG. 7 shows an alternative method of attaching image carriers.

The images, in the embodiment being described, are arranged in a predetermined sequence on the periphery of rotatable wheels or drums 11 as most conveniently shown in FIGS. 5, 6 and 7. The wheels or drums 11 are carried on spindles 12 mounted in bearing carriers 13. Reference to FIG. 3, which shows the underside of the casing 1 illustrates that the bearing carriers 13 are moulded into the lower surface of the rim 2 of the casing. Only two of the bearing carriers 13 are shown in FIG. 3 but it will be appreciated that similar carriers will be provided in the other corners and supported equally along the spindles 12.

The casing 1 is moulded from a synthetic plastics material with the bearing carriers 13 integral with it, alternatively the casing can be made from other materials, for example wood.

A series of six windows 14 are provided in line with each of the spindles 12 and the wheels or drums 11 are dimensioned and mounted on the spindles so that part 15 of the periphery thereof projects through its associated window 14. In FIGS. 3 only one spindle 12 is shown in position with one of the wheels 11 mounted on it and carrying symbols representing those of a dice. At the left side of FIG. 3 another wheel 11 is shown in this case carrying letters as symbols and on the right hand side a further wheel 11 is shown, in this case bearing various different colours.

The windows 14 and the dimensions of the symbols are arranged so that only one symbol is displayed at a time through the window.

One side of each of the wheels 11 is provided with a ratchet gear 15 which is engaged by a moulded flexible finger 16 so that although the wheels can be rotated manually the flexible finger engages the sprocket 15 and holds them in the set position thus providing a ratchet action. The symbols which provide the images on the wheels 11 can be held in place in various ways, for example as shown in FIG. 6, they can be provided as separate inserts 17 which engage suitable mountings 18 on the periphery of the wheel or they can be provided on a band 19 which is suitably located on the periphery of the wheel 11 as shown in FIG. 7. With the arrangement shown in FIG. 6 the sequence of the symbols can be altered if desired or alternative symbols can be inserted.

Figure 9:
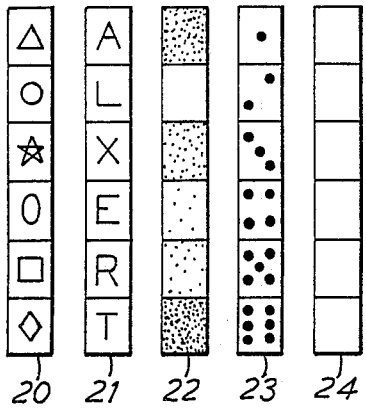
FIG. 9 shows the various forms of image to be applied to the variable indicators.

FIG. 9 shows strips of various symbols which can be used, for example, strip 20 shows a series of devices, strip 21 shows a series of letters, strip 22 different colours, strip 23 dice symbols and strip 24 is intended to represent a series of raised or perforated surfaces to provide a braille type surface so that the game can be played by blind people.

Figure 4:
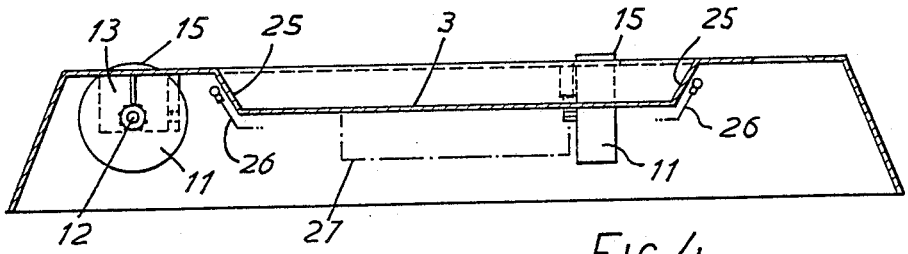
FIG. 4 is a cross-sectional side elevation of the apparatus shown in FIG. 1.

As shown in FIG. 4 the outer edges of the flat portion 3 are provided by dished walls 25 and these can be made transparent if desired with suitable lights 26 carried behind them to provide illumination through the transparent portion. A battery or other electrical equipment is indicated diagrammatically at 27.

Figure 2:
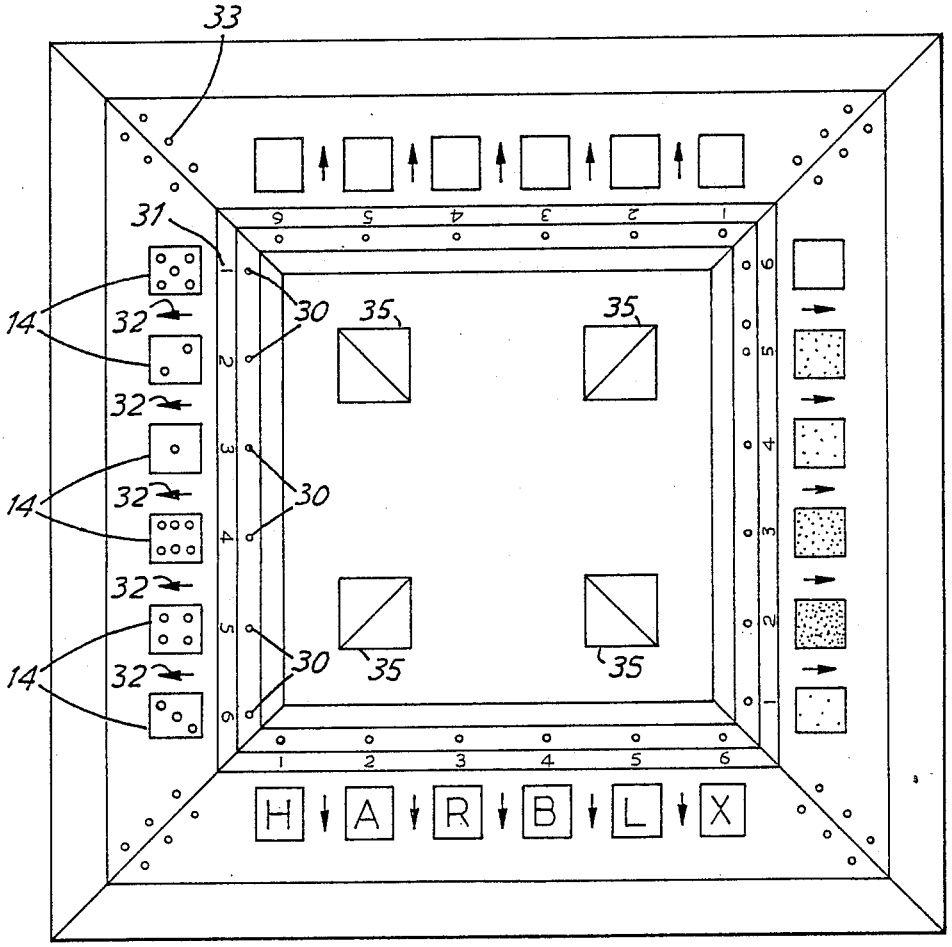
FIG. 2 is a top plan view in more detail of the support part of the apparatus shown in FIG. 1.

The upper surface of the casing, as shown in FIG. 2, carries a series of sockets 30 which are aligned with each of the windows 14 and each window is numbered by a reference numeral 31. In the arrangement shown in FIG. 2 the numbers are from 1 to 6 on each side of the casing. In order to render the drawing clear reference numerals have only been provided on the left hand side of FIG. 2. An arrow 32 is provided adjacent each of the windows 14 to indicate the intended direction of rotation of the wheels 11.

Figure 23:
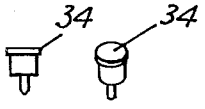

Also provided on the upper surface and in each corner are six further sockets 33. The sockets 30 and 33 are intended to receive "freeze" pegs 34 two of which are shown in FIG. 23. Six pegs are provided for each player and are located in the holes 33 when they are not being used in the play of the game.

In one version of the apparatus the flat surface 3 can be provided with markings, indicated by reference numeral 35, carrying instructions for play and the significance of this arrangement will be described hereafter. Also, if desired, overlay sheets, not shown, can be provided which can be placed on the flat surface 3 carrying different sets of instructions.

Figure 14:
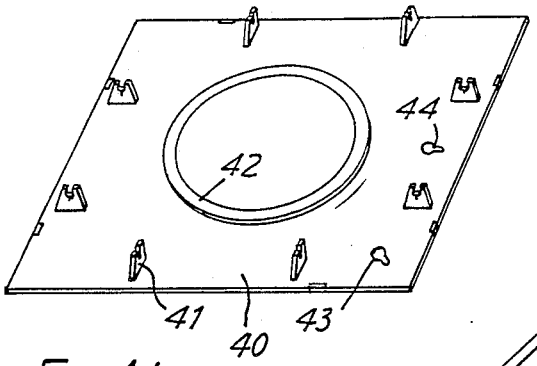
FIG. 14 shows another alternative form of construction employing a base.

In an alternative construction, as shown in FIG. 14, the casing 1 can be provided with base 40 which carries additional spindle support bearings 41 and which may replace the spindle supports 13 if desired. With this arrangement the centre portion of the base is provided with a raised rim 42 to facilitate rotation of the casing on a flat surface and keyhole slots 43 and 44 are provided so that the casing can be hung on a suitable support, such as a hook, on a wall.

Figure 15:
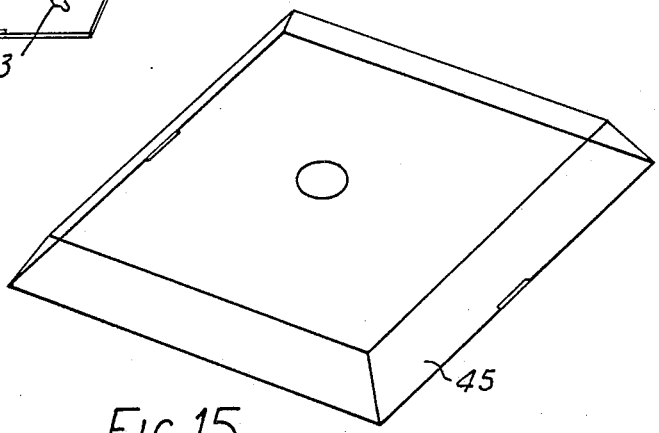
FIG. 15 is an isometric view of a cover for the apparatus.

FIG. 15 shows a transparent cover 45 which can be placed over the casing 1 to preserve the upper surface and prevent unintentional movement of the variable indicators if the game is put to one side during play.

The apparatus also includes a pair of dice, indicated by reference numeral 46 in FIG. 1 and a master random indicator which will be referred to herein as the master dice 47.

The master dice can take various forms and in its simplest form has a number of options which are at least one less than the number of arrays of images, for example a simple master dice could be six sided and carry two sets of numerals 0, 1, 2 on its sides.

Figure 18:
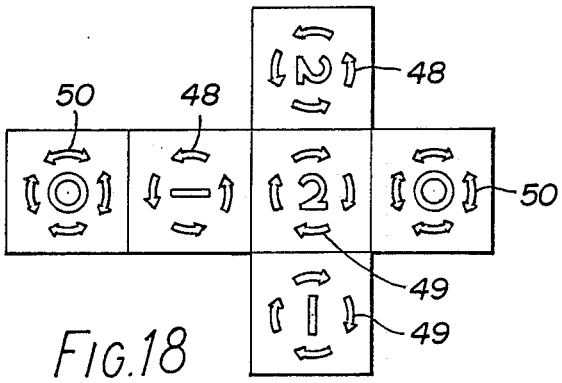
FIG. 18 shows the layout of images for another alternative form of master random indicator.
Figure 19:
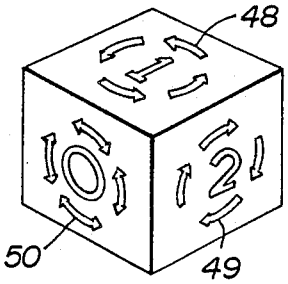
FIG. 19 is an isometric view of a master random indicator using the images set out in FIG. 18.

The master dice can be arranged to provide two or more instructions for play and such a dice is shown in FIGS. 18 and 19. It will be seen that each side of the dice carries a numeral, for example the FIG. 2 and a series of arrows. The arrows are in three configurations, thus the arrows indicated by reference numeral 48 indicate an anticlockwise direction and are provided on reference numerals 1 and 2, the arrows 49 indicate a clockwise direction and are provided on the other numerals 1 and $\bar{2}$, and arrows 50 indicate both directions and are provided with numeral 0. Thus, each side of the dice bears two pieces of information.

It will be appreciated that this master dice can carry a larger number of variations and those described above are only by way of example. In a further variation the arrows could be omitted and the faces could be arranged to carry different colours to indicate left or right hand movement or movement in either direction.

Figure 16:
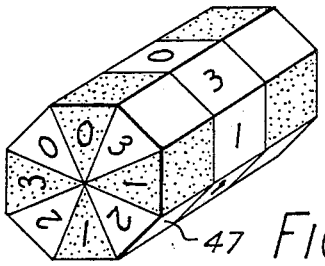
FIG. 16 is an isometric view of a master random indicator for use in the game.

FIG. 16 shows another form of master dice which has eight faces and which can be used with a game provided with six arrays rather than four as shown in FIG. 1. For this form of dice once again various colours can be employed, typical examples being red and yellow, red indicating that the game should be rotated in one direction related to the players by the number indicated and yellow in the opposite direction. The significance of this movement will be explained hereafter in the Rules.

The master dice could be replaced by a set of cards or a top or any other form of random indicator which can carry the necessary instructions.

The master dice will preferably be about twice or more the size of the other dice 46 so that it can be easily distinguished.

In order to prevent the game scratching a polished surface when physically rotated in accordance with the Rules of the game the support may be mounted on a small rotating plynth or pedestal (not shown).

As the rim 2 of the casing is raised in relation to the flat surface 3 this provides a convenient well in which the various dice can be thrown by the players. The well also provides a convenient way of locating an alternative sheet carrying instructions 35 so that previous instructions are masked or perhaps only some of them depending upon the level of difficulty of the game being played. The sheet may be of thin plastics material and may have its own instructions 35 with playing instructions already printed on it.

If electric lighting arrangements 26 are incorporated this will serve to light up the wheels and the central well so that the game can be played under subdued lighting conditions.

It will be appreciated that the ratchet arrangement on the wheels will not only provide a definite movement to ensure that each image is displayed cleanly and fully in the window but movement of each wheel will be accompanied by a sharp "click", mainly for the benefit of blind players. This action will also prevent any "free wheeling" of the wheels.

Consideration of the drawings will show that each player is confronted with an array of images, in the arrangement described six images are provided and this enables the game to be played with a reasonable level of skill. The images are not arranged in order on each wheel but are in a predetermined random order and six different images are available on each wheel. It will be apparent that unless a player memorises the particular random sequence for each wheel, which will be very difficult, he is not aware of the next image which will appear when the wheel is moved in either direction.

In the form illustrated numbers are separate from colours, colours from letters, etc. but a mixture of faces could be provided which are not naturally associated to provide a more difficult form of the game.

If desired a number of replacement wheels 11 can be provided which can be used to replace the wheels in use at any time and thus, before the start of each game, the wheels could be interchanged so that no player would be aware of the "hand" of wheels which he had received.

As will be seen from the drawings the configuration of the apparatus is such that all players have a clear field of view of the images being displayed.

As mentioned above generally there will be three dice in use, the two standard dice 46 which carry numerals or markings 1 to 6 on their six faces and which will generally be used together and the master dice 47. Use of the master dice will usually be initiated by a player throwing any double except a double six but this can be varied depending upon the game which is being played. The master dice is used to instruct the players with regard to rotating the board so that one player's hand which is shown on the array will be passed to another player. In a typical example the arrangement could be that should a player throw a "0" with the master dice the position of the board will not change; a "1" will mean each player inherits the hand of the opponent one place to his left or his right; a "2" will mean each player inherits the "hand" of the opponent two places to his left or his right, etc. It will now become apparent that the arrows as shown in FIGS. 18 and 19 or the colours on the various faces of the dice can dictate the direction of movement. Detailed explanations of the use of the master dice are set out in the Rules but it must be pointed out that the master dice does not necessarily come into use in all varieties of play.

The standard dice 46 are used by each player to dictate his rotation of the wheels 11. Thus, in a typical example of play, should the player throw a 2 and a 5 then he will move wheel 2, the wheel number being indicated by the numeral 31, one window image in the direction of the arrow 32. He will also move wheel 5 in the same direction. The instructions 35 carried in the well can be used to control the movement of the wheels even further. Thus, if the instructions in a particular square 35 in the well stated "reverse" and if a dice lands on this square then the movement of the wheel 11 is in the opposite direction to the arrow 32. This type of play is covered in the Rules.

Figure 8:
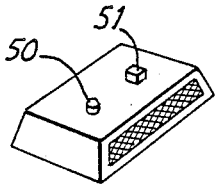
FIG. 8 is an isometric view of an audio device to replace the variable indicators of the kind shown in FIG. 1.

If the game is intended for use by blind players suitable apparatus (not shown) will be provided which includes a loud speaker and various speech "chips" and two buttons so that movement of the buttons will produce a random result which will be spoken by the loud speaker. This arrangement obviously replaces the random indicators represented by the dice 46. The shape of the buttons can be different to enable discrimination between the ordinary dice 46 and the master dice 47. Dice selection will be electronically randomised and the power will be supplied by a battery/transformer. A suitable "voice box" is shown in FIG. 8. The push button for the standard dice being indicated by reference numeral 50 and that for the master dice by reference numeral 51. It will be seen that the two push buttons are of different shapes.

The game play is entertaining and educational. The Rules for play show the latter point well but a brief description is also included here to highlight this point. The object of the game is to arrange a selection of colours, numbers, shapes, etc., depending upon what is provided on the wheels 11 in a predetermined order in the windows. When letters are used it may be decided that actual words must be formed to score points.

One way of playing the number game will now be described by way of example.

When the standard dice 46 are thrown and show two numbers, for example 5 and 4, depending upon the level of play (difficulty factor) this will indicate that the number 4 wheel and the number 5 wheel can be rotated one place in the direction of the arrows 32 to reveal a new image in the window. Alternatively it could also be that by using elementary mathematics, the three indicator could be rotated three moves to make a total of nine. In another variation the number rolled by the dice could be divided so that the six wheel would move once, the two wheel would move once and finally the one wheel once to make a total of nine again. By simple concentration of thought a player could quickly find the appropriate wheels to move to their best advantage. On the blind version it will assist in the teaching of braille, of learning different shapes, aid memory and concentration whilst still being entertaining.

When the game is played on a greater level of difficulty, the hardest of which can take up to two weeks to complete, the "freeze" pegs shown in FIG. 23 come into play. The purpose of these is to prevent an opposing player from moving a given wheel, therefore making it impossible for them to win the game without first "unfreezing" it. Although as shown in the drawings these pegs are merely pegged into the sockets 30 and 33 in the casing they could be arranged so that when placed adjacent the wheels they physically lock the wheel and prevent rotation.

The freeze pegs 34 are also used for protecting a players own hand as shown in the array while trying to build a winning combination. It is obvious that by removing these freeze pegs (by for example the throw of a given number) it can be advantageous. The Rules for play may also state that a wheel must be rotated when the dice show unless it is protected by a freeze peg.

A master dice 47 allows one player to "steal" the hand of another and thereby brings in an element of chance and of risk. It prevents the most gifted player from always winning thereby prolonging interest and amusement for slower thinking opponents by giving them equal opportunity. The master dice also adds a greater excitement to the game.

An added attraction is that blind players can compete equally with sighted people on appropriate apparatus. Moreover, if, for example, a solo game is being played and the player is becoming bored the game can be put away and resumed at a later date. If a game has been played consistently by a player to such an extent that he is beginning to recognise which random number or image is coming next all or some of the wheels can be removed, shuffled and then replaced.

It is intended that most of the apparatus can be made by one piece injecting moulding with various apertures necessary if lighting is incorporated. The game can also be reduced in overall size to a pocket version so that it can be played by travellers.

It will also be appreciated that the game need not be in the form of a board, it could merely consist of a suitable support carrying two or more arrays and the dice could be rolled on a separate surface. This construction is particularly advantageous for a pocket version or travelling game.

The game can also be constructed as a computor and/or an electronic version, thus the arrays can be provided by liquid crystal displays, (LCD) or light emitting diodes (LED), the variable indicators being manually operable by control means which operate a memory to provide the images of the LCD or LED, it could be arranged that only one of the images held in the memory is provided in a LCD or LED at a time and a control means may also be arranged so as to "freeze" the output of the memory on a predecided image or indicator means could be arranged associated with that image display to indicate that it is frozen. It will be appreciated that the general overall concept with the electronic game is of course the same as with the mechanical version.

Such a construction will also be used to provide an "arcade game" for public use.

Although only six wheels are shown in the drawing for each play "n" amount can be used and similarly "n" amount of images can be provided on each wheel, as desired. This is once again only restricted by the size of the support and apertures, in the form of the casing. The wheels may be provided in sets, for examples, colours, numbers, letters, etc. However, where costs prohibit this a standard set of blank faced wheels can be supplied and the colour number, etc. images can then be slotted into the wheel individually in the manner shown in FIG. 6 or a band can be provided as in FIGS. 7.

The standard six sided dice 46 can be replaced if more than six wheels per player are used in the game. If, for example, eight wheels per player are used then an eight sided dice or "spinner" will be required and this will also apply to the master dice itself. An eight sided dice will be required for the six player version to ensure the game will get full rotation as required. Similarly is a spinner or top is used as the random indicator it must show eight options.

The Rules for various versions of the game are set out below and in these Rules the peg position apertures 33 are referred to as "park positions", the aperture positions 30 for the pegs are referred to as "playing positions" and the surfaces on which the images are provided on the wheels are referred to as "faces".

INTRODUCTION

Designed as a family game, in every sense of the word, Rotation has been developed with care and integrity. Different levels of play ensure that children as young as seven years old can compete on an equal footing with adults, but the game will act as a teaching aid for even younger players.

One of the main features of the game, which is for one to four players, is that players may join or leave at any time without disrupting play. A novel approach to playing a partner game is that partners may sit beside each other rather than the traditional way of always sitting opposite.

Each player is faced with a set of six wheels. Each which has six faces of randomly set numbers from one to six. However, these faces may be replaced with randomly selected letters of the alphabet, or even colours or shapes, to form a different game of strategy.

All a player needs to do to win is to arrange these six wheels so that the faces show an equal value across the six. The letter wheels are arranged so that six letter words can be formed to achieve a winning line. Winning is not strictly governed by this, other levels of play may use other methods.

Because all wheels are open to view, players can interfere with other players wheels under the rules of play. This aggressive act creates conversation, doubt and bluff.

It is strongly advised that new players to Rotation start at a level of play of a very basic nature and gradually work themselves to more difficult games as they become more proficient with the system.

SETTING UP THE GAME

To set up the game place all Freeze Pegs in their part position on the corners of the game. As in the diagram above, a dice is thrown into the Dice Well and all wheels on the game are set up to show this value.

Each player then throws a dice to determine who goes first, highest wins.

THE BASIC GAME

This game, for two to four players, needs very little skill. For the beginner it teaches basic moves essential for understanding harder levels. This game used the two standard dice only.

The first player, player 'A', throws the two dice into the dice well. The two dice always relate to the numbers above the wheels. If, for example, the dice show a 5 and a 2 then the wheels numbered 5 and 2 must be turned one face in the direction of the arrows. If the two dice are the same, turn that wheel two faces. Play then goes to the next player on the left. Play continues until a player throws a six on one, or both dice, which introduces other options.

For example, the dice thrown shows a 6 and a 3. This player now has the choice of three options:

(1) Plays the 6 and 3 wheels as normal. Play then passes to the next player.

(2) States they wish to freeze any one of their six wheels. This is done by taking any one of the freeze pegs from its park position and placing it directly above the selected wheel, in the hole provided. This wheel, is now deemed as "frozen" and cannot be turned.

(3) States they wish to un-freeze any one of their wheels which may be frozen on their own hand. This is done by removing a freeze peg and returning it to any vacant park position on the game.

All freeze and un-freeze actions must be carried out first and then the remaining points indicated on the second dice used up on the correct wheel. This rule can be used to advantage, for as in the example above with a 6 and a 3, a player can freeze their wheel numbered 3 first and then pass play, the wheel numbered 3 being frozen and therefore unplayable. Similarly, if a player un-freezes their wheel numbered 3 first they are then able to rotate it one face before passing play to the next player.

A player throwing a Double Six can:

(1) Rotate their wheel numbered six, two faces.

(2) Freeze or un-freeze any two of their wheels.

(3) Freeze or un-freeze any one of their wheels and turn their wheel numbered six, one face.

(4) Freeze any one of their wheels and un-freeze any other one of their wheels.

This player then gets another throw for throwing a Double Six.

On this basic level of play, unless a wheel is already frozen, the two wheels corresponding to the dice must be played. If one wheel is frozen then the other wheel must be played. If both wheels, as indicated by the dice, are frozen, then play passes to the next player who will then throw his dice.

A player cannot be deemed a winner unless they have used all points as indicated by the two dice. If one of their wheels is frozen and a winning line is revealed on the turn of one wheel then this is a legal win. If, however, both wheels are un-frozen and therefore playable and a winning line was revealed after the turn of one wheel only, this would not be a legal win as the second wheel would still have to be played.

On this basic level of play a winning line is the first player to get all wheels showing the same value, other than the value of the wheels when setting up the game for play. Variations of winning, and players' with the letter wheels, are explained in detail under the section entitled How to Win.

For a four player game, see "Partner Play" section.

THE MASTER DICE

This dice, marked 0, 1 and 2 in Red and also 0, 1 and 2 in Lemon on its six faces is unique to the game of Rotation.

This dice can be played (1) Compulsory; (2) Optionally; (3) Not at all. Its sole purpose is to rotate the game. For example, if a player throws the Master Dice and it shows Red 1, then the game must be physically turned 90 degrees to the right. This will mean that this player has just lost their hand to the player on their immediate right, and they will inherit a hand from their immediate left. If there is no player to their immediate right, the game must still only be rotated 90 degrees. This hand will then become a dummy hand which may be brought into play if the game rotates again.

If a player throws a zero the game must not be rotated and play continues to the next player. A two thrown on the Master Dice rotates the game 180 degrees, the next player then has their throw. The Master Dice options are:

(1) Compulsory, on the throw of any double. (Except a Double Six)*

*If a player throws a Double Six on the Compulsory Master Dice level then the rules of the Optional Master Dice level apply.

Any player throwing any double on the two standard dice must not take any points at all, and the Master Dice must then be brought into play and the game rotated accordingly.

(2) Optional, on the throw of any double.

A player now throwing any double has a choice to either throw, or not to throw the Master Dice. If they choose not to throw it then they must use the points in the normal way.

(3) No Master Dice.

The Master Dice is not brought into play at all, and all points must be used in the normal way.

On throwing of a Double Six, players must first abide by the above chosen option, and are then entitled to another throw of the two standard dice.

RULES ON FREEZING

On the basic game of Rotation, players are only allowed to freeze or un-freeze their own wheels.

Players familiar with the rules of play, may wish to proceed to the next level of play, which incorporates more strategy of freezing or un-freezing any wheel on the game. Players, on the throwing of a Double Six are still able to play their points as normal.

Interferring with other players wheels in this way, can prevent them from playing wheels they would like to thus forcing them to rotate other wheels they would not normally wish to.

If playing using the Master Dice it is worth remembering that ~~any~~ other players wheels are liable to be inherited by yourself, this strategy is worth bearing in mind'

The game of Rotation encourages conversation between players because all players can see each others wheels at all times. Straight forward help can often be hidden as a bluff or counter-bluff, both on this level and especially when playing using the Add and Divide rule.

THE ADD AND DIVIDE RULE

On the basic game all players can only play the wheels relating to the two standard dice as thrown. The Add and Divide rule allows for players to add the sum total of the two dice together and use the points over the complete range of the six wheels.

For example, if a player throws a 5 and a 4 on the two dice making a total of 9 points, they may:

(1) Play their wheels numbered 5 and 4 as normal.

(5 wheel, one face)+(4 wheel, one face)=9 points.

(2) Decide to divide their 9 points, e.g.:

(3 wheel, two faces)+(1 wheel, three faces)=9 points.

(4 wheel, one face )+(2 wheel, one face)+(3 wheel, one face)=9 points.

etc., etc.

Wheels which are already frozen, as indicated by a freeze peg, are not allowed to be turned and must be disregarded. If because of an excess of freeze pegs a player cannot, in any way, take their points in full then they must pass play to the next player without taking any points at all, also, if a player tries to pass play and other players agree it was possible to take the points, then they player must take the points regardless of whether they wished to take them or not, before the next dice are thrown.

A player declaring a win without having used all of their points, will not be deemed a winner. All points must be played—or no points must be taken at all. Players must first clearly state their intention before moving wheels, giving time for other players to object on the grounds of a foul move.

No player, at any time during the game, must rotate any wheel more than five faces per dice throw. For example, a player throwing a 5 and a 3 would not be entitled to take all these points on their wheel numbered 1—a rotation of eight faces.

THE SECOND FREEZE RULE

Points are not taken on this level of play when freezing, the Six thrown is the enable to freeze or un-freeze and the number shown on the second dice being the only wheel that is allowed to be frozen or un-frozen.

Freezing on the standard game of Rotation is optional, as is the case when playing the Second Dice Freeze rule.

When playing this rule a player throwing (say), a six and a three can only freeze their wheel numbered 3.

If playing a level where players may freeze or un-freeze ANY player then this player can only freeze or un-freeze any player (including themselves) on the wheel numbered 3 only.

A player throwing a Double Six can, amongst other options, freeze or un-freeze any wheel numbered 6. They are then entitled to a free throw.

SOLO PLAY

Solo play on Rotation is similar to the card game of Patience. A player may cheat if they wish, but in the long term they are, after all, only cheating on their selves, aren't they?

A solo player may select any level of play they wish, and if they use the Master Dice can play as many different set of wheels as they wish from one to four, as they come into play.

If, by throwing the Master Dice, the player receives a set of wheels frozen in a winning format they can immediately throw the Master Dice again to select another hand.

A solo player playing the harder levels can expect to be playing the same game for a very, very long time before completing it.

One consolation is that the game can always be hung up out of the way, with its lid on to secure all playing pieces until ready to re-commence.

PARTNER PLAY

A partner game may be formed at any time the total number of players equals four, and all players agree. This is covered under the "Joining or Leaving" section of the rules.

At the start of a partner game players are faced with two options. They may play directly opposite each other as is standard with most other types of games or they may play on the diagonal, virtually sitting beside each other. Diagonal and opposite partner play do differ especially if the Master Dice option is being exercised. Once a partnership is formed it must remain for the duration of the game, players are not free to swap partners at will. However, if a player decides to leave and make partner play impossible the game can still be played on, each player as individuals.

Partner play on the basic game is easy. A player throwing the dice may, if they wish, play all the points on their partners wheels. The player throwing the dice always has final say on this, their partner only being able to advise on the merits of such a choice.

A player with both wheels un-frozen and a partner with both wheels un-frozen may not split the points between the two. All points must be used on one hand or the other in this case. There are, however, restrictions on how the points may be used if there are any freeze pegs in play at the time. Partner selection is always optional, no player is ever forced to take points on their partners wheels if they do not wish to. A player with both wheels frozen and unable to play either of the two dice numbers can pass play to the next player in turn without selecting their partner, even though their partner may have both wheels un-frozen and therefore open to play.

If both the player and their partner have a wheel each frozen then the player may play the points shown by the other dice on their partners hand. For example, the two dice thrown show a 3 and a 2. The player has a 3 wheel frozen and their partner has a 2 wheel frozen. The player throwing the dice has free choice whether to play their own wheels or their partners. This would be equally true if both player and partner had (say) their 3 wheel frozen.

It is obvious that if both wheels of a partners hand are frozen then a player cannot in any way select their partner, and must take points on their own wheels if possible. A player with one frozen wheel, and having a partner with none frozen, may elect to just play the one free wheel left to him on his own hand. Remember, selecting to play points on a partners hand is entirely optional at all times.

When playing partner level using the Add and Divide option of play then the rules of play alter. A player may not select their partner unless all points can be used on their partners wheels. On the add and divide option points cannot be split between the two sets of wheels. Selecting to play partners wheels is once again entirely optional, a player unable to take all of the points on their own hand must pass play to the next player in turn, even though they know their partner could have taken them. The next player now throws his dice. Remember, all points must be used or none whatsoever.

When freezing on partner play, the remaining points after freezing may also be used on a partners wheels instead of the players. This again is entirely optional, a player always having freedom of choice whether to use up the points on their partners wheels. Rules of play still apply, a player must take their points if they are able to do so before passing play to the next player.

Two players may play a form of partner play. They may elect to play two sets of wheels each under the rules of play for partners. As there is no partner on the other set of wheels no dice must be thrown in the partner position, play only passing between the two players. On the throw of the dice a player can elect to play the points on their other hand to form a winning line. If using the Master dice option and the game rotates then the hand now in front of them is now classed as the primary hand.

JOINING AND/OR LEAVING

Players may join or leave the game of Rotation without any undue effect to the run of play. The maximum amount of players which can be accommodated at any one time is four.

A player can leave the game at any time, but they must not alter, or interfere with any of the playing pieces when they do so. This players hand will now become a dummy hand, which will come into play if the Master Dice options are selected. The remaining players are free to freeze or un-freeze any wheels on this dummy hand under the rules of play.

Four players, playing a partner game, need not start a new game if one (or more) players have to leave. Although the partner game is void, players can still play on individually and hence win on their own merit.

If players join or leave, the level of play may be altered to suit and new options of play may be introduced if all players are agreed.

A new player joining a game already in play has free choice which available set of wheels to play. Existing players must remain with the current set of wheels they are playing. If the new player brings the total to four then a partner game may be formed, if all other players agree to this. New options of play may be introduced or taken out at this time.

A player having to break off play on a temporary basis, e.g. to make some refreshment, may do so without halting play. This hand is now classed as a dummy hand, a partner game reverting to standard, until the player returns.

If the game is to be left temporarily by all players for any reason, the lid may be placed over the game which will retain all playing pieces in their correct position, and the game hung on a wall for safe keeping.

HOW TO WIN . BASIC LEVEL

Winning is achieved by forming a line of numbers of the same value on all six wheels, other than the original value set at the start of play, or by forming a run which can be read in either direction.

For example: 2 2 2 2 2 2 or 4 4 4 4 4 4 or 1 2 3 4 5 6 or 6 5 4 3 2 1.

On the basic game the first player to achieve any one of these combinations is the winner, provided that they have used up all of their points.

When playing partner play on this level of scoring, winning can be any one of these variations:

(1) The first partner to form a winning line, wins the game for both players.

(2) Both partners must each have a set of wheels on a winning line, to win. (*)

(3) Both partners must each have a set of wheels of the same values, to win. (*)

*If any hand is completely frozen up on all six wheels in a winning formula, this set of wheels cannot be tampered with in any way. These wheels are deemed to be protected even though the game rotates under the rules of the Master Dice.

HOW TO WIN . (POINTS GAME)

Players may decide to play for points, a winning line being designated points as follows:

| | |
|---|---|
| 6 6 6 6 6 6 | 600 Points |

-continued

| | |
|---|---|
| 3 3 3 3 3 3 | 300 Points |
| 1 2 3 4 5 6 | 750 Points (reverse, the same) |

Once a player has won on a specific line, this line becomes void until they have won again on a different combination of numbers. For example, if a player has scored 400 Points by forming a line of fours then this cannot be scored on again until they have scored on (say) a line of two's. A line of two's now becomes void to them, but a line of four's is now free to be achieved. If using the Master Dice option and the game rotates away from a player with a winning line, the new player can also score with this line providing the line is not void to them. If the game rotates away with a winning line and immediately returns to the same player they are not entitled to score again on this, as this is still void to them.

If playing partner play, a players partner may score if the game rotates to them with a winning line, providing that this is not a void set of numbers to the partner. The rule of play is always that no player can score twice on the same set of numbers in succession.

As soon as any player has won the first game, the numbers used for the original setting up can now be used to win on. Remember, no player can win twice on any set of numbers in succession, under any circumstances.

HOW TO WIN . (LETTER WHEELS)

On the basic game of Rotation using the letter wheels, points are scored for eacher letter that makes up a word from two to six characters. These words must be listed in the Oxford Dictionary. Each letter scores 10 Points.

Words formed within words also score. e.g. the word J O I N E R

| | | |
|---|---|---|
| (1) J O I N E R | = | 60 Points |
| (2) J O I N | = | 40 Points |
| (3) I N | = | 20 Points |

Total scored as above would be 120 Points.

A player having scored thus, would not be able to score again on the above words until they have scored on another different word.

Partner play rules are the same as the basic game using the number wheels.

A more advance way of scoring is:

| | |
|---|---|
| (1) * * | Frozen wheels |
| (2) 1 2 3 4 5 6 | Wheel numbers |
| (3) H 0 U S E J | Formed words |

Instead of scoring 10 Points per character, scoring is by adding the values of the actual wheel numbers together. Any frozen wheel will score double. Points scored in the above example are:

| | | |
|---|---|---|
| U S E | = | 12 Points + 3 Points for frozen letter 'U' |
| | = | 15 Points |
| U S | = | 7 Points + 3 Points for frozen letter 'U' |
| | = | 10 Points |
| H O U S E | = | 15 Points + 4 Points for 'H' and 'U' |
| | = | 19 Points |

Total points scored on these words is 44 Points.

Partner play is the same as above.

The table top game reads from left to right only. The computer game version is different insomuch as it reads in both directions.

GAMBLING LEVELS

Gambling on Rotation is similar to any other type of gambling game, each player being responsible for knowing the stakes and also for knowing how much these stakes can be raised during the game, whilst played.

Setting up Rotation for gambling levels 1, 2 and 3 is the same. Make sure all Freeze pegs are in their park position on the corners of the game and rotate all wheels in front of each player one face, in the direction of the game by the throw of a dice, highest wins. Players then take turns in order to start each new game. Rules for setting up level 4 are covered later.

Players can raise the stakes when it is their turn by an amount up to the maximum, as set by players before play commences. They are also entitled to drop out of play, when their turn comes, without having to add to the kitty. They will, of course, be liable to the eventual winner for any monies gambled up to this point.

Partner play can be played on levels 1, 2, 3 but not on level 4. A player can select their partner, who may be sitting opposite or diagonally, and play a wheel on their partners hand instead of their own. The player has final say over their partner on this decision.

ROTATION GAMBLING LEVEL 1

The first player throws one of the standard dice into the dice well and they may play any single wheel which shows one digit above the number on the dice. For example, if the dice shows a 4 then a player can select any single wheel showing a 5 which they then place a Freeze peg over, to show this wheel has been played. This player then turns the dice so that the number 5 is uppermost to indicate to all players that this is now the number to follow. This player will not input any stake money into the 'kitty' because they have been able to play.

However, if this player did not have a number 5 showing on any of their wheels they are then required to turn any single wheel one face in the direction of the arrows, and add to the 'kitty'. The dice would remain on the number 4 for the next player in turn to follow.

Wheels which are played successfully, and therefore frozen, must not be turned under any circumstances.

When the dice is showing a 6 then the next follow on number will be a 1. This ensures that play is continuous until a player manages to freeze up their final wheel. The game is now over and this player wins the game and the 'kitty'.

Any player able to follow on and freeze a successfully numbered wheel has free choice whether to play this wheel, or not. They may decide to turn any other free wheel one face and add to the 'kitty' instead, if they think this strategy could prevent any other player from winning.

After the game is won, remove all freeze pegs to their park positions and turn all wheels one face in the direction of the arrows. The next player in turn will then throw the Master Dice and rotate the game accordingly. After removing the Master Dice they start the new game with a throw of a standard dice.

ROTATION GAMBLING LEVEL 3

This level of play follows the rules of level 1, with two exceptions:

(1) Wheels must be frozen consecutively from wheel numbered 1 to wheel numbered 6.

(2) Players can play one digit below the dice as well as one digit above. For example, if the dice shows a 6 then play is followed with either a 1 or a 5. If, say, the dice shows a 1 then play follows with either a 6 or a 2.

As soon as a player has been successful in freezing their wheel numbered 1 they are now free to freeze their wheel numbered 2 and so forth up to wheel numbered 6. The first player to freeze their wheel numbered 6 will be the winner and will claim the kitty.

Any player unable to freeze their correct wheel still has free choice of any free wheel to rotate one face and add to the kitty, and any player may also turn any free wheel and add to the kitty even though they could follow on, on their correct wheel to prevent the opposition from winning.

ROTATION GAMBLING LEVEL 3

The rules of play follow the rules of level 2, with one exception:

(1) Players can only play one digit above the dice value.

Note: Players are always entitled to drop out on their turn without adding to the 'kitty', and they may also raise the stakes on their own turn as previously mentioned.

ROTATION GAMBLING LEVEL 4

'THE GAME OF NINETEEN

Initial setting up is for all freeze pegs to be in their park positions on the sides of the game, and for all wheels to be set to show the number 1.

The aim of the game is for all six of a players wheels, when frozen, to be as near nineteen as possible, when the sum total on the faces is added together. The winner will be the player, at the end of the game, who is either on a total of 19, or is closest to 19 either above or below. Players cannot 'bust' on this game by being above 19.

Having determined the stake level and the maximum the stakes can be raised, play is started by the player throwing the highest on a single dice. Players will then take turns in starting each new game.

The first player places their bet and throws a single dice into the Dice Well. They may rotate any wheel in the direction of the arrows by an amount of faces as shown by the dice. All points must be used on this single wheel selected, and a freeze peg placed over the wheel to show this wheel has been played.

Play passes to the next player in turn who must then place their bet before throwing the dice, and taking the dice points on any free wheel. Wheels which are frozen (already played) must not be turned under any circumstances.

Players may raise the stakes on their turn before they throw the dice, and they may also drop without having to add further to the 'kitty'. All monies gambled to this point will, however, have to be paid to the eventual winner.

Players must always remember that only frozen wheels count toward the score. Wheels yet to be played are invalid, a player must have all six wheels frozen to count at the end of the game. Therefore, a player reaching 19 with four frozen wheels must play the remaining two wheels to qualify for a score.

A player below nineteen will always beat a player equal distance above nineteen. For example, a player finishing with a total score on their six wheels of (say) 15 will beat a player on (say) 23. Two, ore more, players who are tied on exactly the same number (which is the closest to 19) will be entitled to play off on a new game, to determine the eventual winner. All stake money gambled will also ride on this new game.

At the end of each game the Master Dice is thrown and the game rotated accordingly.

Wheels are not reset, but all freeze pegs must be removed to their park position.

ROTATION LEVEL 4 ADVANCED LEVEL OF PLAY ONLY

On the standard gambling game of Nineteen's (level 4) players may raise the stakes on their turn before the dice is thrown. On this advanced level of play the rules of play for stake monies are different.

Initial stake money must be preset to a figure agreed by all players, which all players input to the 'kitty' with when they play their first wheels. When play returns back to the starting player, who will now be playing their second wheel, this initial amount is doubled in value for all players to input when their turn comes about.

Consequently, when the third set of wheels are played this new value will be doubled again and so forth until the sixth and last wheels are played.

Players are still entitled to play any free wheel they wish when their turn comes, and are also entitled to drop out of play without adding further to the kitty on their turn. Any stake money gambled to this point is still payable to the eventual winner, who on this level could be the last player left in.

All other Rules of Rotation Standard level 4 still apply.

Rules for Game played on computer and/or electronic version are set out below and the terminology will be understood by any one familiar with such apparatus.

SETTING UP THE BASIC GAME

After the initial "Rotation" introduction screen, players will be faced with a menu screen, inviting them to input options of play.

The basic game of Rotation is set up as follows:

PLAYERS 1–4. Input the amount of players using keys 1, 2, 3 or 4.

If there are four players the next menu line will ask:

PLAY PARTNER GAME Y - N. Press 'N' key for NO. This will then pass the next option which is solely for partner play.

| | |
|---|---|
| MASTERDICE OPTION Y - OPT - N | Press 'N' key for NO |
| USE ADD and DIVIDE RULE Y - N | Press 'N' key for NO |
| SECOND DICE RULE Y - N | Press 'N' key for NO |
| FREEZE OWN ONLY Y - N | Press 'Y' key for YES |
| SCREEN COLOUR 1–9 | Select colour from chart |

Immediately the screen colour has been selected the screen will display the game of Rotation with the information you have selected displayed on information boxes. Data is being loaded from the disk at this time, until the two dice appear randomising themselves in the screen centre. Player 'A' then presses return key to stop the dice and the game is now in play.

If the above options have not been correctly selected, then press SYSTEM RESET to re-boot the disk otherwise remove the game disk from the drive. Now follow the section headed 'The Basic Game'.

THE BASIC GAME

This game, for two to four players, needs very little skill. For the beginner it teaches basic moves essential for understanding harder levels. This game uses the two standard dice only.

The first player, player 'A', selects the two dice in the dice well by pressing the RETURN key. The two dice always relate to the numbers above the wheels. If, for example, the dice show a 5 and a 2 then wheels numbered 5 and 2 must be turned one face by pressing these keys. If the two dice are the same, turn that wheel two faces by pressing the same key twice. Play then goes automatically to player 'B' who hits the RETURN key to select his dice.

Play continues until a player throws a 6 on one, or both dice, which introduces other options. For example, the dice thrown show a 6 and a 3. This player now has the choice of three options:

(1) Plays the 6 and 3 wheels as normal. This is achieved by pressing 'P' for play, and playing relevant wheels.

(2) Decides to Freeze any one of their six wheels. This is done by selecting the 'F' for Freeze Mode. You are then asked which player you wish to Freeze, which on this level can only be yourself. Having selected self (A, B, C or D) you are then invited to pick any wheel of your choice from 1–6. This wheel is now out of play (frozen).

(3) Decides they wish to un-freeze any of their own wheels already Frozen by pressing 'F' for Freeze Mode, and selecting player and wheel as above.

All Freeze and Un-freeze actions must be carried out first and the remaining points indicated on the second dice used up on the correct wheel. This rule canbe used to advantage, for as in the example above with a 6 and a 3, a player can Freeze their wheel numbered 3 first and then pass play by pressing the SPACE BAR. The next player in turn will then be invited to ACCEPT this move by selecting 'Y' or 'N' for Yes or No. As this has been a legal move it must be accepted.

Similarly a player can Un-freeze their wheel numbered 3 first and then rotate it one face. Play will automatically pass to the next player in turn.

A player throwing a double six can:

(1) Rotate their wheel numbered 6, two faces after selecting 'P' to Play.

(2) Freeze or Un-Freeze any two of their wheels after selecting 'F' for each wheel.

(3) Freeze or Un-freeze any one of their wheels and turn their wheel numbered 6, one face by selecting 'F' firstly and 'P' secondly.

(4) Freeze any one of their wheels and Un-freeze any other of their wheels by selecting 'F' each time.

This player will automatically have another throw for throwing a double six.

On this basic level of play, unless a wheel is already Frozen, the two wheels corresponding to the dice must be played. If one wheel is Frozen then the other wheel must still be played and play passed using the space bar routine without penalty.

If both wheels are frozen then play passes to the next player by means of the SPACE BAR once again without penalty.

A player cannot be deemed a winner unless they have used all points as indicated by the two dice. If one of their wheels is Frozen and a winning line is revealed on the turn of the remaining wheel then this is a legal win.

If, however, both wheels are Un-frozen and therefore playable and a winning line was revealed after the turn of only one wheel, this would not be a legal win as the second wheel would still have to be played. In this case the POINTS LEFT BOX must equal zero.

On this basic level of play the winner is the first player to get all wheels showing the same value.

Variations of winning, and players' with the letter wheels, are explained in detail under the section headed 'How To Win'.

Four a four player game, see 'Partner Play' section.

RULES ON FREEZING

On the basic game of Rotation players are only allowed to freeze to un-freeze their own wheels.

Players familiar with the rules of play, may wish to proceed to the next level of play, which incorporates more strategy of freezing or un-freezing any wheel on the game. This level must be selected at start of play thus:

FREEZE OWN ONLY Y-N answer 'N' for NO.

Players, on the throwing of a double six, can still select 'P' for play as normal.

Interfering with other players wheels in this way, can prevent them from playing wheels they would like to, thus forcing them to rotate other wheels they would not normally wish to.

If playing using the Master Dice it is worth remembering that any other players wheels are liable to be inherited by yourself.

The game of Rotation encourages conversation between players because all players can see each others wheels at all times. Straight forward help may not be what it seems as this could be a bluff both on this level and especially when playing using the Add and Divide rule.

THE MASTER DICE

The Master Dice is a unique function to the game of Rotation and can be selected in one of three ways at the start of a game.

Its sole purpose is to rotate the game. For example, if the Master Dice result is '1>>>' then the game will be rotated 90 degrees anti-clockwise, if the result was '1<<<' then the game will rotate 90 degrees clockwise.

If a '1>>>' was the result, this would mean that player 'A' will lose their hand to player 'D' and will inherit the hand from player 'B'. If no one is playing the 'D' position, this hand is regarded as a dummy hand which may come into play again if the game rotates again.

If a '0' is the result, the game will not rotate and play will pass to the next player. A '2' will rotate the game 180 degrees and likewise continue with the next player.

If a player threw a Double Six then they always get a free throw, regardless of any option they chose to play.

The Master Dice Options are:

(1) Compulsory, whenever a double is thrown (Except a double six)(*).

*If a player throws a double six on the Compulsory Master Dice level, then the rules of the Optional Master Dice apply.

(2) Optionally, on the throw of any double. A player throwing any double has the choice to either throw or not to throw the Master Dice. If they choose not to throw it then they must select 'N' for NO, and use the points as per rules of play.

(3) Not at all. The Master Dice is not played at all and points must be used in the normal way.

If a double six is thrown, players must first abide by their above chosen option, and will then receive a free throw.

THE ADD AND DIVIDE RULE

On the basic game all players can only play wheels relating to the two standard dice, as thrown. The Add and Divide Rule allows for players to add the sum total of the two dice together and use the points over the complete range of the six wheels. For example, if a player throws a 5 and a 4 on the two dice, making a total of 9 points, they may:

() Play their wheels numbered 5 and 4 as normal.
(5 wheel one face)+(4 wheel one face)=9 points.

(2) Decide to divide their 9 points, e.g.:
(3 wheel two faces)+(1 wheel three faces)=9 points or
(4 wheel one face)+(2 wheel one face)+(3 wheel one face)=9 points also. etc.

Wheels which are already frozen cannot be turned even though the relevant key is pressed, and points will not be deducted in the 'POINTS LEFT' box.

If, because of an excess of Frozen wheels, a player cannot take their points in full then they must not take any points at all, and pass play to the next player using the SPACE BAR routine. If other players ACCEPT this they will then press the 'Y' key for Yes.

If a player takes some, but not all points, on a certain combination of wheels and cannot use the remainder because of Frozen wheels, and also then passes play using the SPACE BAR routine they will probably receive play back if other players press the 'N' key because they have realised the points could have been used in full if the player had used another combination. This player must take the remaining points in full, even if they have to use the 'U' key to un-freeze their wheel numbered 1 (if frozen) to take them. When all points have been used play will automatically pass to the next player.

A player declaring a win without having used all of their points will not be a winner. All points must be played—or no points must be taken at all. Players must firstly state their intention before moving having allowed time for other players to object on the grounds of a foul move.

No player, at any time during the game, must rotate any wheel more than five faces per dice throw. For example, a player throwing a 5 and a 3 would not be entitled to take all of these points on their wheel numbered 1—a rotation of eight faces. If any player attempts to move a wheel more than five faces the computer will reset their wheels to a starting position.

THE SECOND DICE FREEZE RULE

Points are not taken on this level of play when freezing or un-freezing, the six thrown is the enable to freeze or un-freeze and the number showing on the Second Dice being the only wheel which is allowed to be frozen/un-frozen. Having selected the Second Dice Rule, the computer ill not allow a player to do anything else when freezing.

Freezing on the basic game of Rotation is optional, as is the case when playing the Second Dice Freeze Rule.

When playing this rule a player throwing (say) a 6 and a 3 can only freeze their wheel numbered three (or un-freeze the same), and play will automatically pass to the next player after this has been carried out.

If playing a level where players may freeze or un-freeze ANY player, then this player can only freeze or un-freeze any player (including themselves) on the wheel numbered 3, play then passing automatically to the next player in turn.

A player throwing a double six can, amongst other options, freeze or un-freeze any wheel numbered 6. They are still entitled to a free throw.

SOLO PLAY

Solo play on Rotation is similar to the card game of Patience. A player may cheat if they wish, but in the long term they are, after all, only cheating on themselves, are they not?

A solo player may select any level of play they wish and can also play as many different sets of wheels as they wish, from one to four.

For example, a player wishing to play only one hand can select 1 on the menu screen at the start of play when it is showing 'How Many Players 1–4'. They may select other choices of 2, 3 or even 4 sets of wheels at this time.

A solo player attempting the harder levels can expect to be playing the same game for a very, very long time before completing it.

PARTNER PLAY

A partner game may be formed at any time when the total number of players equals four. Players may play opposite, 'A & C' plays 'B & D'; or diagonally, 'A & B' plays 'C & D' and with the Master Dice in play these are considerably different. Once a partnership is formed it must remain for the duration of the game, players are not free to swap partners at will. However, if a player decides to leave and therefore makes partner play impossible, the game can still be played on, playing as individuals. (See Joining or Leaving).

Points must be played on one hand or the other hand and cannot be split between the two. Players must ensure before selecting 'P' (key) for Partner that all points can be played on their partners hand. A partner can immediately return the points back to the player, providing no points have been used, using the SPACE BAR if they realise the points cannot be fully used.

If selecting Partner on the basic game and one wheel is turned with the other frozen, points have been used and the partner will not be allowed to return back to the player. The only escape is to play the frozen wheel where upon the players wheels will be restored to the start position.

When using the Add and Divide Rule, a partner may return play with not points taken without penalty. If points have been taken then all points must be used and this is achieved by pressing the SPACE BAR to un-freeze the wheel numbered 1 (if frozen) to take the remaining points. Remember, any wheel turned more than five faces will immediately restore the players wheels to a starting position.

If at any time a player chooses to freeze or un-freeze anyone, the remaining points can only be played on the players hand only.

Two players may play a form of partner play. They may elect to play two sets of wheels each under the rules of play for 'Partners', playing either opposite or diagonally.

By studying the above rules carefully, players may discover that cheating can be turned into 'gamesmanship'. For instance, if a player wished to destroy a hand quickly why do it the hard way ???

JOINING AND/OR LEAVING BY MEANS OR THE 'OPTION KEY'

Players may join or leave Rotation without any undue effect to the run of play. The maximum amount of players which can be accommodated at any one time is four.

A player can leave the game at any time, before their turn comes around and while the dice are spinning by pressing the OPTION key. New levels of play may also be introduced at this time, if all players agree. Key commands after the OPTION key has been pressed are:

'L' key for Leave 'J' key for Join

'X' key to change level only

Any players hand, after they have left, will become a dummy hand which may still be inherited by either players if the Master Dice option is in play. This dummy hand can still be frozen or un-frozen under the rules of play, e.g. Freeze 'Own' or Freeze 'All'.

Four players playing a Partner game need not start a new game if one (or more) players have to leave. Although the Partner game is void, and all partner facilities removed by the Computer, players can still play on individually and hence win by their own efforts.

A new player joining a game already in play has free choice which available set of wheels to play. Existing players must remain with the current set of wheels they are playing. If the new player brings the total to four then a partner game may be formed, either as Opposite or Diagonally opposed providing all players agree to this. Other options may also be introduced or taken out at this time, to suit.

A player having to break off play on a temporary basis, e.g. to make some refreshment, may do so without halting play. If they use the OPTION key as above to leave then Partner play facilities will be removed by the computer and this hand will become a dummy hand under the rules of play. However, a player leaving on a temporary basis may allow their partner to play their hand instead, if they so choose.

HOW TO WIN (BASIC LEVEL)

Winning is achieved by forming a winning line of numbers of the same value on all six wheels, or by forming a run which can be read in either direction.

| | |
|---|---|
| For example: | 2 2 2 2 2 2 or 4 4 4 4 4 4 |
| | 1 2 3 4 5 6 or 6 5 4 3 2 1 |

On the basic game the first player to achieve any one of these combinations is the winner, providing they have used up all their points under the rules of play.

When playing Partner play on this level of scoring, winning can be any one of these variations which must be selected before play commences:

(1) The first partner to form a winning line wins the game for both players.

(2) Both partners must each have a set of winning wheels to win the game.(*)

*If any hand is completely frozen up on ALL six wheels in a winning formula then this set of wheels cannot be tampered with, in any way. These wheels are deemed to be protected even though the game rotates under the rules of the Master Dice.

(3) Both partners must each have a set of winning wheels exactly the same value to win the game.

HOW TO WIN (POINTS GAME)

Players may decide to play for points, a winning line being designated points as follows:

| | |
|---|---|
| 6 6 6 6 6 6 | 600 points |
| 3 3 3 3 3 3 | 300 points |
| 1 2 3 4 5 6 | 750 points |

Once a player has won on a specific line, this line becomes void until they have won again on a different combination of numbers. For example, if a player has scored 400 points by forming a line of fours then this cannot be won on again until they have (say) scored on a line of twos. A line of twos now becomes void to them, but a line of fours is now free to be achieved.

If using the Master Dice option the game rotates away from a player with a winning line, the player inheriting this line can also score on it providing the line is not void to them as well.

If the game rotates away with a winning line and immediately returns to the same player, they are not entitled to score again on this as this is still void to them.

During partner play, a players partner may score if the game rotates to them with a winning line, providing once again that this is not a void set of numbers to them.

The rule of play is that no player can ever score twice on the same set of numbers in succession.

HOW TO WIN (LETTER WHEELS)

On the basic game of Rotation with the letter wheels, points are scored for each letter which makes up a word, from two to six characters. These words must be listed in the Oxford Dictionary and each letter scores 10 points. Words formed within words also score, for example the word J O I N E R .

| | | |
|---|---|---|
| (1) J O I N E R | = | 60 points |
| (2) J O I N | = | 40 points |
| (3) I N | = | 20 points |

The total scored would be 120 points

A player having scored thus would not be able to score again on the above words until they have scored on another different word.

Partner play rules are the same as the basic game using the number wheels.

A more advanced way of scoring is:

| | |
|---|---|
| (1) * * | Frozen wheels |
| (2) 1 2 3 4 5 6 | Wheel numbers |

-continued

| (3) H O U S E J | Formed words |
|---|---|

Instead of scoring 10 points per character, scoring is by adding the values of the actual wheel numbers together and any frozen wheel will score double. Points scored in the above example are:

| | | |
|---|---|---|
| U S | = | 7 points + 3 points for frozen letter 'U' |
| | = | 10 points |
| U S E | = | 12 points + 3 points for frozen letter 'U' |
| | = | 15 points |
| H O U S E | = | 15 points + 4 points for frozen letters 'U' and 'H' |
| | = | 19 points |

Total points scored on these woulds would therefore be 44 points.

GAMBLING LEVELS OF PLAY

Gambling on Rotation is similar to other types of gambling games, as each player must be responsible for knowing both the stakes and by how much these stakes can be raised during the game.

Setting up Rotation for the following four levels is the same. The computer will automatically randomise the wheels and play will, initially, begin with player 'A'. Players then take turns, in order, to start each new game. Partner play is available on levels 1, 2 and 3, but not on level 4.

The menu screen at the start of play will invite players to select:

| | | |
|---|---|---|
| (1) How many players | (2–4) | Use keys 2 to 4 to input amount of players |
| (2) Level of play | (1–4) | Select game to be played. |
| (3) Player partner game | (Y-N) | Only available on a 4 player game. |
| (4) Max. raise value | (1–9) | The most a player can raise per turn. |
| (5) Input stake value | (1–5) | Initial starting stake for each player. |
| (6) Screen colour | (1–9) | Select colour, to suit, from chart. |

Players are entitled to raise the stakes when it is their turn by the use of the 'R' key, but only up to the amount as set in (4) above. The computer will now allow this limit to be exceeded. Players cannot raise after they have used any points.

Any player is entitled to drop out of play when their turn comes about without having to add further to the kitty. However, any player who raises the stakes first will not be allowed to drop out until their next turn. The 'C' key, for chicken, enables players to drop out.

Partner play can be selected on levels 1, 2 and 3, but not on level 4. Partner play is arranged so that 'A' and 'C' always play 'B' and 'D' Diagonal play is not available on these levels of play. Partner play is selected by the use of the 'P' key, and once selected a player is totally comitted to their partners wheels. They do, however, have final say over their partner.

The computer will keep a tally for each player in the appropriate information box, and also the total running 'kitty'. When the game is won and the RETURN key is pressed the game remaining visible for about 25 seconds, whilst it selects new wheels and numbers, giving time for players to settle their account.

ROTATION GAMBLING LEVEL 1

At the start of play a random number will be shown on the dice in the screen centre. Initially player 'A' will start by playing any single wheel which displays one digit above the number on the dice. For example, if the dice shows a 4, then a player can select any wheel showing a 5. By pressing the key relevant to that wheel which displays the number 5, this wheel will then be frozen to show it has been played successfully. The computer will not allow this wheel to be selected again. The number on the dice in the screen centre will now be updated to show a 5 to indicate to all players that this is the number now to follow. Because this player has been successful in following the number they will not be debited any stake money.

However, if this player did not have a 5 showing on any of their wheels they would then have to turn any single wheel to reveal a new number and they will be debited automatically by the computer, and the dice will remain on the number 4 for the next player in turn to follow.

A player may turn any free wheel and add to the 'kitty' rather than follow on, if this move will prevent another player from winning.

Whenever the dice shows a 6 the next follow on number will be a 1. This ensures that play is continuous until a player manages to freeze up their final wheel. The game is now over and they win the 'kitty'.

To start a new game, press the RETURN key and the wheels will be randomised.

Remember, any player can use the 'C' key to chicken out on their turn, and can also use the 'R' key to raise the stakes a previously mentioned.

ROTATION GAMBLING LEVEL 2

This level of play follows the rules of level 1, with two exceptions:

(1) Wheels can only be frozen consecutively from 1 through to 6.

(2) Players can now play one digit below, as well as one digit above the dice.

For example, if the dice shows a 6 then play is followed with either a 1 or a 5. If the dice shows a 1 then play follows with either a 6 or a 2.

When a player is successful in freezing their wheel numbered 1 they are now free to freeze their wheel numbered 2 etc., etc, and the first player to freeze their wheel numbered 6 will be the winner and will claim the 'kitty'.

Any player who cannot 'follow on' may turn any free wheel one face and add to the kitty, and also a player who is able to 'follow on' may also turn any free wheel and add to the kitty if they think this strategy will prevent any of the opposition from winning.

ROTATION GAMBLING LEVEL 3

The rules of play follow the rules of level 2 with one exception:

(1) Players can only play one digit above the dice value.

Note: Players are always entitled to 'chicken out' on their turn and may also raise the stakes, as previously mentioned.

ROTATION GAMBLING LEVEL 4

This game requires each player in turn to rotate any wheel of their choice, by the amount showing on the dice in the screen centre. When this full amount has been taken the wheel will automatically be frozen by the computer to show it has been played. The player at the end of the game who is on 19, or nearest to 19 when the sum total of the digits on the six frozen wheels are added together, will be the winner.

Once a player has selected a wheel and used any points on it, they must stay on this wheel. They will not be allowed to take any remaining points on any other wheel. A frozen wheel will not be in play, and no points will be deducted if any player attempts to play one. When all points, as shown by the dice, are used correctly then this wheel will be frozen and their stake money will register in the correct information box. Play will then pass to the next player in turn who must press the RETURN key to stop the dice spinning.

Players can raise the stakes up to the maximum set at the start of play. This is achieved by pressing the 'R' key after the dice has stopped spinning.

Players may also drop out of play when they have stopped the dice spinning. The 'C' for chicken key will immediately take them out of play, and play will pass directly to the next player in turn. Any player dropping out will still be liable to the eventual winner for any money gambled to this point. However, any wheels played, or unplayed, will not count in any way to a score. These wheels are totally void until a new game is re-started.

Two, or more players at the end of the game, who are equal distance above and below 19 will not tie. The player who is on the low side of 19 will always win. For example, if a player is on (say) 21 and another is on 17, then the winner will be the player on 17.

If two, or more, players are tied on exactly the same number these players must play a tie breaker game, using the same rules of play. Any other player(s) not involved when this new game is started must immediately drop out when their first turn comes, using the 'C' key. This method bypasses the need to re-boot the disc.

BACKGROUND SCREEN COLOURS

Background screen colours can be selected on the intial menu screen at the start of play, using keys 1 to 9. The chosen colour will remain until the disc is re-booted. Colours are:

(1) Black
(2) Grey
(3) Deep Red
(4) Plum
(5) Purple
(6) Lilac
(7) Blue
(8) Bright Blue
(9) Green These colours may vary, Rotation Ltd. reserving the right to change and modify the game of Rotation.

Figure 12:
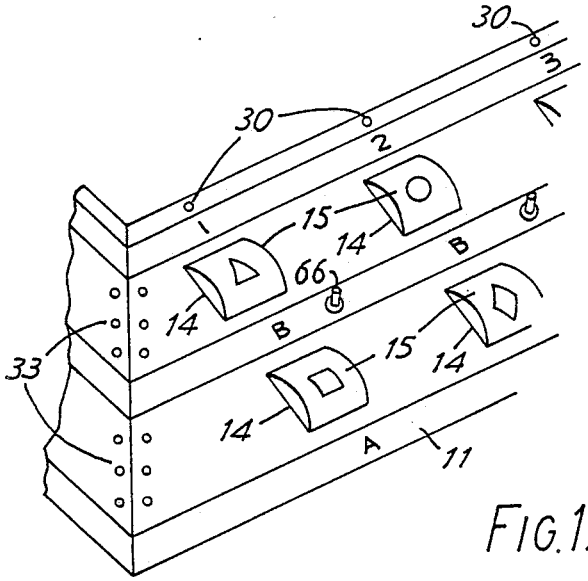
FIG. 12 is a fragmentary view of another alternative form of the apparatus.
Figure 13:
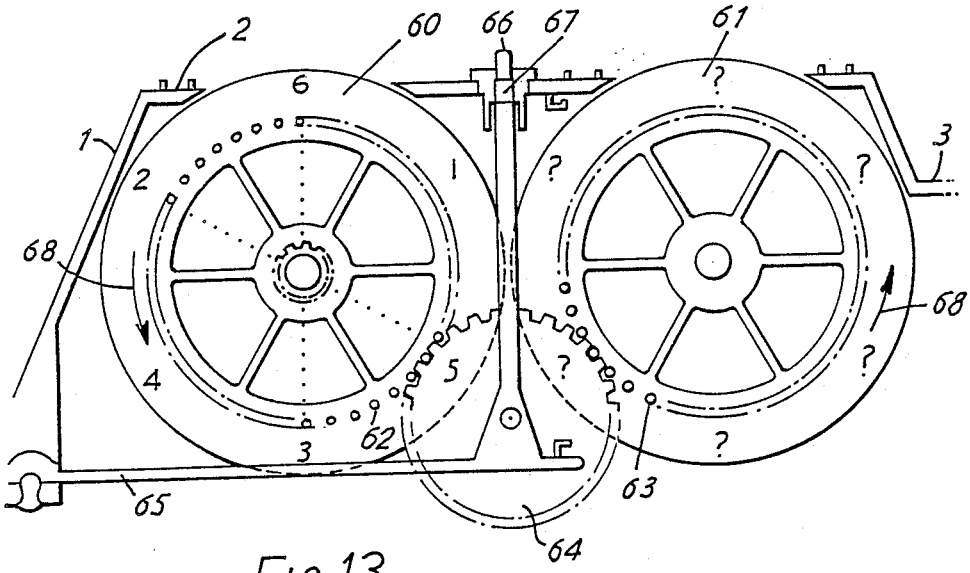
FIG. 13 is a cross-sectional view of the variable indicators in the apparatus shown in FIG. 12.

In a modified construction of the apparatus, as shown in FIGS. 12 and 13, and in which the same reference numerals are used to indicate similar parts each array 10 comprises two sets of variable indicators in the form of interconnected wheels 60 and 61. The general configuration of the wheels 60 and 61 is similar to the wheels 11 and once again they are visible through windows 14 in the casing 1. Freeze peg holes 30 and 33 are again provided for each set of wheels.

As will be seen from FIG. 13 the wheels carry gears 62, 63 which intermesh with a transfer gear 64. The transfer gear 64 is carried on a flexible mounting 65 which can be operated through a spring loaded plunger 66 which projects through the top of the casing. Operation of the plunger 66 against a return spring 67 causes the flexible mountings 65 to move downwardly taking the gear wheel 64 with it so that the wheels 60 and 61 can be disconnected. When one of the wheels 60 or 61 is moved in a given direction the other wheel will move in the same direction, as indicated by arrows 68. When the gear 64 is disconnected however the wheels can be moved independently.

It will be appreciated that this construction is in effect an exact duplication of the single set of wheels per player as shown in FIG. 1. Although any number may still play, time of play will keep the number down to a realistic level. The second set of images may be controlled only after certain requirements from the first set have been met, for example, a six shown on the number two window will mean that the number two window of the second indicator can then be adjusted on the next throw. Freezing and interference by an opponent may rapidly change this situation. The game will be completed only when the second set of indicators are in the correct alignment. The above arrangement is with the wheels disconnected.

The gear ratio between the wheels is arranged so that when one image is produced on one wheel the next single image will be reproduced on the other wheel. This will prevent a player seeing, and therefore anticipating, what is coming next on the second set, alternatively the ratios could be 6:1, 3:1, 2:1 or otherwise as required.

This construction can be used for games similar to those set out in the Rules or alternative games can be designed especially for its use.

Again, an electronic version of this construction can be provided.

Figure 10:
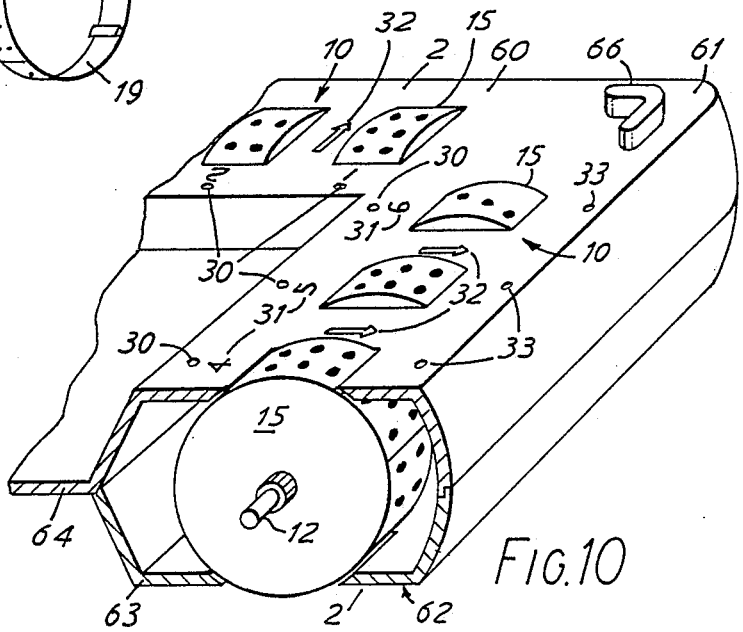
FIG. 10 is a part-sectional isometric view of an alternative construction of the apparatus.
Figure 11:
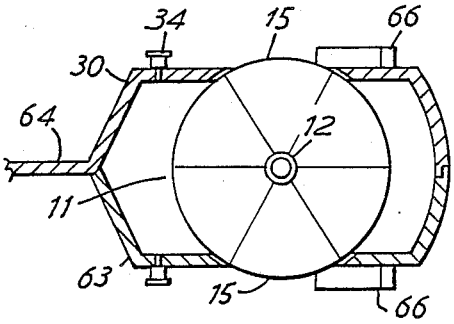
FIG. 11 is a cross-sectional side elevation of the apparatus shown in FIG. 10.

FIG. 10 and 11 show another alternative construction in which two or more arrays 10, in this case four, are provided on the upper side 60 of a support 61 and a similar number on the lower side 62. This construction is arranged by providing a lower peripheral cover 63 secured to an upper portion 64. The edges once again provide raised rims 2 and each side has a flat surface 3 which acts as a well. Freeze plug sockets 30 numbers 31 and arrows 32 are provided on both sides of the casing but in this construction the freeze plug sockets 33 are arranged in a row along the edge as will be seen from FIG. 10.

Each upper and lower corner is provided with an upstanding corner piece 66 so that the exposed portions 15 of the wheels do not rest on the supporting surface.

Figure 17:
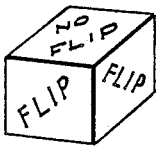
FIG. 17 is an isometric view of another form of master random indicator.

With this version of the apparatus a different form of master dice is used and is shown in FIG. 17. The dice is marked with the words "flip" or "no flip" on various faces. Once again a dice or cards could be employed. With this game, rather than rotating the casing about a vertical axis when it is moved from one player to another, the casing is rotated about a horizontal axis thus revealing the lower arrays. Thus when the master dice is thrown and shows "flip" the casing is rotated. Once again the dice can carry additional information, for example colours or arrows, to indicate the direction of rotation.

If desired the game could be played so that not only is the casing "flipped", but in certain games rotated simultaneously or separately about a vertical axis.

Figure 20:
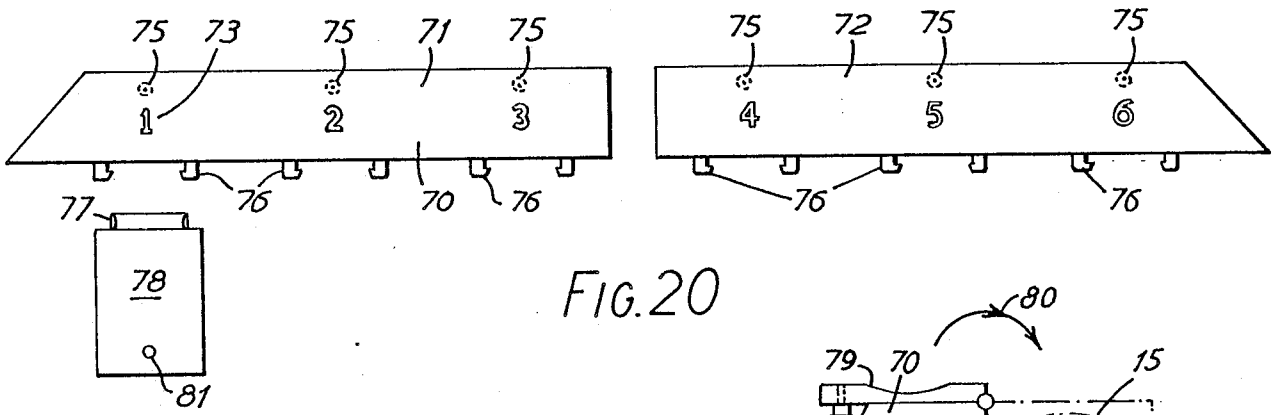
FIG. 20 is a plan view of means for optionally concealing the images of the various arrays.
Figure 22:
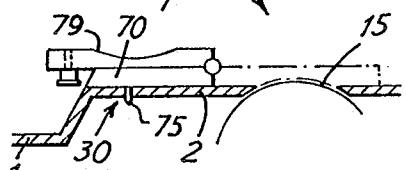
FIG. 22 is a side elevation partly in cross-section showing the concealment means in position; and, FIG. 23 shows two pegs which can be used to indicate that an image when displayed must not be altered and must be regarded as "frozen" in position.
Figure 21:
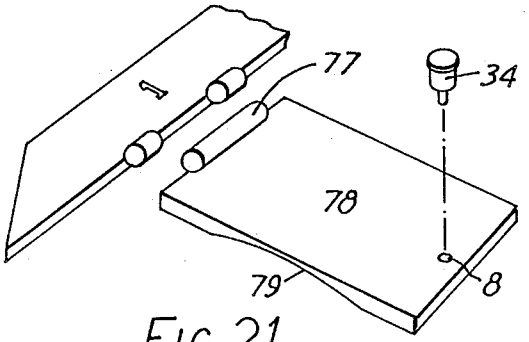
FIG. 21 is an isometric view of the apparatus shown in FIG. 20.

FIGS. 20, 21 and 22 show means which can be provided on any of the apparatus arrangements set forth above and which optionally conceal the images on the various arrays.

The optional concealment means comprise a strip of plastics material 70 which is divided into two parts 71 and 72 which are basically identical apart from being of opposite hand and carrying different numbers. As will be seen from FIG. 20 the strip carries a series of numbers 73 which extend from 1 to 6. A series of location pegs 75 are arranged beneath the lower surface and are most clearly shown in FIG. 22. The construction is such that these pegs 75 can be used to hold the strip 70 in place by locating in the existing peg holes 30. Arranged along one side of the strip are a series of six sets of hinges 76 which located on co-operating lugs 77 provided on shaped flaps 78. Each flap 78 is substantially rectangular and has a lower surface provided with a concave groove 79. The flaps 78 are aligned on the strip 70 so that when the strip is in place on the casing 1 the flaps can be folded downwardly in the direction of the arrow 80 in FIG. 22 to the position shown in broken lines where they extend over and conceal the exposed part 15 of the wheels thus concealing the image carried thereon. The outer end of the upper surface of each flap is provided with a freeze peg hole 81 into which a freeze peg 34 can be inserted as shown in FIG. 21. The strip 70 is provided in two portions which can either be used together so that all six wheels of an array can be covered or only one strip can be used so that half the array is covered and the other half revealed.

The use of the concealment flaps opens up the possibilities of a further range of games and the Rules for five further games are as set forth below :

ROTATION GAMBLING GAME

LEVEL 1 (USING FLAPS)

Any player of this game who is familiar with the game of poker, should soon pick up how to play this game.

By now players should know there are six wheels per player, each with numbers ranging from one to six in a random formula, therefore the highest winning hand would be 6 6 6 6 6 6.

It also follows that a player with six wheels of the same number, no matter what the number, would beat any other player with only five wheels of any number, no matter what the number.

It is also true that a player with e.g. 5 5 5 5 5 4 would beat both (1) 5 5 5 5 5 3 and this player would beat (2) 5 5 5 5 5 2.

A player with 4 4 4 4 3 3 would beat (1) 4 4 4 4 6 5 or (2) 4 4 4 4 2 2 because they have a pair after their four numbers. This pair is powerful and will beat 6 6 6 6 5 3.

A high run: 1 2 3 4 5 6 beats a low run 6 5 4 3 2 1, and both runs beats any 5 of a kind, but not any 6 of a kind.

INITIAL SETTING UP

All wheels are set up to number one, and then a dice is thrown by each player in turn who rotates all of their wheels by the amount shown on the dice, and covers each wheel as they do so, this randomises the wheels. Order of play is determined by the throw of a dice.

PLAY

Having established the stakes, play will commence with each player in turn from player one, declaring a pair. If no players have a pair to open with then all wheels are reset by the throw of a dice as before.

A player declaring an opening pair will then place his stake into the dice well, and all players wishing to gamble on their hand will follow.

The opening player than has the option to either:

(a) Keep his hand as is.

(b) Throw one of the two dice.

(c) Throw both dice.

If the opening player decides to keep his hand as is, then this option extends to the second player etc., etc.

If a player decides to throw either one or two dice then:

(a) Rule of play states that the points showing on the dice will be on an Add & Divide basis. This means that if for example a total of NINE was thrown then wheel (4) could be rotated two faces (making eight points used) and wheel (1) rotated one face to bring the total points used to the dice score, of NINE points.

(b) All players must state their intention to the other players before moving any wheel. This prevents any player from rotating so far, and seeing what they want then stopping and taking the points up on other wheels.

(c) Players can only rotate any wheel a maximum number of five faces.

(d) All points shown on the dice thrown must be taken. This is a rule of play, and must be remembered as it can be a disadvantage as well as an advantage.

When all players have re-set their hand, if they wish to, then the opening player will either decide to carry on and place his stake in the dice well or fold. A player may fold (stop gambling) any time his turn comes around and will then have no further claim in the game.

When play has been reduced to two players, either player may see the other and the highest hand will win. In the case of two identical hands, the player who asked to see the other will lose.

To start a new game, the masterdice is thrown and the game is rotated accordingly, wheels are not set to show a number one in the windows as before, all that needs to be done is throw a dice and turn all wheels in turn as mentioned at the start of play. If a six was thrown then it must be thrown again.

Advanced level: Wheels 1, 2, 3 are never covered.

LEVEL 2 (USING FLAPS)

INITIAL SETTING UP

All wheels are set to show the number 1. Each player throws a dice into the dice well and all six wheels are rotated by the amount showing on the dice. If the dice shows a 6 then it must be thrown again. Each player takes turns to rotate their wheels and lower their flaps, this prevents cheating. Now determine who plays first by throwing a dice (highest starts). On subsequent games players take turns to start.

Each player must determine how many "tricks" they think they can make. The first player starts the bidding, new bids must better the previous bid. The player with the highest bid starts the game by uncovering any one of their wheels. Each player in turn uncovers their selected wheel that either beat this number or will "play off" lower numbers. Obviously, the first player to play a 6 on a wheel cannot be beaten, and will take the round. The winner of the round places a freeze peg over their winning wheel to indicate they have won and this player will start round 2 by uncovering any other wheel.

When all six wheels have been played it will become obvious whether the successful bidder has succeeded, by the amount of freeze pegs they have got.

Scoring is by the amount of pegs, e.g. five points per peg if successful. For example, if a player has bidded 5 wheels to win and wins 5 wheels they would then score 25 points. (If they won 6 wheels they would still only score 25 points). If, however, they failed in their bid and did not get 5 wheels, the opposition would ALL score 25 points and the bidder scoring zero.

Players may substitute cash for points instead.

Re-setting the game is by throwing the Master Dice and rotating the game by the amount showing on the Master Dice. Players then re-set wheels as per dice value as before.

LEVEL 3 (USING FLAPS)

INITIAL SETTING UP

As level 2.

The first player uncovers any wheel and the remaining players, in turn, try to beat this number revealed. The first player to play a 6 on a wheel will obviously win on this round. The player playing the highest number wins the round and places a freeze peg over their wheel. This player restarts the next round by uncovering another wheel.

Play continues until all 24 wheels have been played, the winner being the one with the most freeze pegs.

Points, of 5 points per peg are awarded to this player only, the remaining players taking zero points.

Partner play can be played on this level.

Resetting the game is the same as level 2 using the Master dice.

From the above it will be appreciated that the various forms of apparatus, especially when fitted with the concealment flaps, can be used to play a multitude of games including various forms of games which are played with playing cards, for example whist or other games.

LEVEL 4 (USING FLAPS)

This level can be played by two, three or four players. When four players are playing they can form a partner game and a partner can sit either opposite or diagonally as covered in other rules of Rotation.

Setting up is the same as level One with all wheels initially set to show the number 1. Each player, in turn, throws a dice and rotates all six of their wheels by the amount shown on the dice. Any player throwing a 6 will be required to re-throw the dice.

Players familiar with the domino game of 5's and 3's will quickly recognise the similarity to this game. Points are scored whenever a wheel is uncovered which is either divisible by a 5 or a 3. For example, if the first player uncovered a number 6 on a wheel they would score 2 points, as $3\times2=6$. The next player following on may uncover a 4 making the running total of $6+4=10$ and also scoring 2 points ($5\times2=10$).

The third player may decide to uncovered a wheel showing a 4. Although the total is now 14 and is not divisible by either 5 or by 3, this player will claim two points for a pair (two fours).

The maximum total of points must never exceed 15. If the fourth player does not have a number 1 then they cannot play and play passes until a player can play a 1. If all players cannot play then this 'rubber' is abandoned and the running total resumes again at zero, with play following on in order from the last player to play a wheel.

In the example above, a player able to uncovered a wheel showing a 1 would score 8 points. This is constructed by $5\times3=15$ and also $3\times5=15$ making a total of 8 points.

Play is finished when all players have played all of their wheels. It is obvious that some players may be able to play all of their six wheels quite quickly whilst others may be left with two or even three wheels left to uncover. These must be uncovered under the rules of play above, the player with all six wheels played and not taking any further part in the proceedings.

When the final player has played their last wheel the game is reset by a player throwing the Master Dice and rotating the game accordingly, and each player, in turn throwing a dice and rotating their six wheels by the correct amount.

Points are also scored by a double and triple system. For example, if a player uncovers a wheel showing a 2 they would not score points. The following player uncovering a 2 would score 2 points for a double ($2+2$) and the third player also playing a 2 would score 6 points for $2+2+2$ and also a further 2 points for a total of 6 ($3\times2$). A fourth player playing a 2 also would score 8 points ($2+2+2+2$).

Players may decide to play for fun, with points being totalled at the end of a time limit, or by a player reaching a pre-determined limit first; or player may decide to gamble at a preset rate of so much per point.

LEVEL 5 (USING FLAPS) ROTATION LIAR DICE

This game is similar to the game known as Liar Dice. Rotation is well equipped to play this type of game using the rotary faces and the rotation of the game itself.

SETTING UP

This game is played on one set of wheels only. The other three sets of wheels are all set to show the number one and are left uncovered to indicate they are not in play. This game can be played by any amount of players, e.g. it is not restricted to four.

Each player will arm themselves with an equal amount of freeze pegs, the suggested amount should be in the region of three per player, these pegs are regarded as lives, and when a player has lost all of this pegs he is out of the game.

When all players have determined who should start the game (usually by the throw of a dice). That player who is known as player ONE will rotate each of his wheels by the amount showing on the wheel, covering the wheel as he does so to prevent any other player seeing the randomised number. Rule of play states that is a '6' is showing on any wheel, that wheel will only be rotated one face.

PLAY

Player one now states what he wishes the next player to him to believe is showing on the wheels. He may state the truth, and pass exactly what the wheels are showing, or, he may tell a lie. If player two accepts this, Rotation is turned so that player two is now in possession of the wheels, each player, in turn, must beat when he has accepted verbally.

Because there is no guarantee that what is passed IS the truth, and a player accepts what is passed on its own merit he must accept the situation without giving any other player any indication or the game will be up for him. This is often a game of pure Bluff and a poker face is usually beneficial. If player one has, for instance, passed player two a set of wheels reading 5 5 4 4 2 1 but has verbally passed him 6 6 6 3 2 1, then player two must pass on to player three anything higher than this which might be (6 6 6 4 2 1). Player two, having accepted the wheels from player one must assess the situation and decide whether he wishes to throw one or two dice. The dice points are on an ADD and DIVIDE basis. This means that if the total sum of the two dice comes to '7' then wheels '1' and '6' can be turned one face each, or wheels '4', '2', and '1' can be turned one face each, etc.

Rule of play states that no wheel can be turned more than FIVE faces at any one throw. Rule of play also states that a player has free choice of throwing one or two dice at his discretion. All points shown on the dice thrown must be used, a player stating his intention to move certain wheels by an amount before actually moving them.

Player two has thrown the dice and used up the points. He knows that no matter what the wheels show under the covers he must pass on more than he was passed to him, he states that he has a 6 6 6 6 5 3. Player three now has to decide whether he thinks this might be possible, he has had no chance to see the wheels at all. He decides that he cannot accept this to be true and thus calls player two a liar, whereupon player two must reveal all the faces of the wheels to all players. If the wheels show that player two had told the truth, then player three will lost one of his lives (gives up a freeze peg). If however, the wheels show that player two has told a lie then player two will lose a life.

The player who has been found to be a liar must then re-start the game as previously mentioned (turn all six wheels and cover).

The winner is the last player in the game with any lives left. A new game started after this may recommence on any other bank of wheels as nominated by the first player to be knocked out.

An alternative to playing using dice is that the dice should not be used but when a player accepts what has been passed, in place of throwing one or two dice, the player may turn any one of the six wheels by a nominated amount (maximum five) and then declare to the next player as usual, for them to accept or reject what is claimed is showing on the wheels.

We claim:

1. Apparatus for playing a game comprising a support carrying at least two arrays of images, each image array comprising a set of at least three manually variable indicators which can be moved in relation to said support, said three manually variable indicators of each set being located one at each of three different peripheral locations upon said support in predetermined positional relationship to each other whereby each positional relationship of a first of said arrays corresponds to a positional relationship of a second of said arrays, at least three images arranged on each indicator, means for selectively generating indicia corresponding to at least each of said three locations and in response to which selected ones of said three images at selected ones of said three locations of each array can be displayed, and each indicator including means constructed and arranged for manual operation by a player for varying each indicator of only one set in relation to said support in response to said location generating means to display selected ones of said three images at selected ones of said three locations.

2. The apparatus as defined in claim 1 wherein said indicators are each a wheel.

3. The apparatus as defined in claim 1 wherein said indicators are each a wheel having a periphery, and each wheel periphery carries one of said at least three images.

4. The apparatus as defined in claim 3 including means for selectively concealing and exposing the images of each wheel periphery.

5. The apparatus as defined in claim 3 including means for selectively concealing and exposing the images of each wheel periphery, and said concealing and exposing means is a flap mounted for pivotal movement.

6. The apparatus as defined in claim 1 wherein said support includes a plurality of windows, and each indicator and the images thereof are visible through said windows.

7. The apparatus as defined in claim 1 wherein said support includes a plurality of windows, each indicator and the images thereof are visible through said windows, and each indicator projects at least partially through an associated window.

8. The apparatus as defined in claim 1 wherein said support includes a plurality of windows, each indicator and the images thereof are visible through said windows, said indicators are each a wheel, each wheel includes a periphery, and a portion of said periphery of each wheel projects through an associated window.

9. The apparatus as defined in claim 1 wherein said support includes a plurality of windows, each indicator and the images thereof are visible through said windows, said indicators are each a wheel, each wheel includes a periphery, each periphery carries one of said at least three images, and a portion of said periphery of each wheel projects through an associated window.

10. The apparatus as defined in claim 1 wherein said support has an upper side and a lower side, at least one of said image arrays is provided at an upper side of said support, and at least a remainder of said image arrays is provided at a lower side of said support.

11. The apparatus as defined in claim 1 including means for indicating that an image when displayed must not be altered thereby effecting a "frozen" position thereof.

12. The apparatus as defined in claim 1 including means for indicating that an image when displayed must not be altered thereby effecting a "frozen" position thereof, and said last-mentioned means is a manually movable element adapted to be manually moved from a non-use position to a location adjacent the image which is to be "frozen."

13. The apparatus as defined in claim 1 including means for indicating that an image when displayed must not be altered thereby effecting a "frozen" position thereof, said last-mentioned means is a manually movable element adapted to be manually moved from a non-use position to a location adjacent the image which is to be "frozen," said support includes an opening adjacent each location, and said manually movable element is selectively insertable in and removable from a selected one of said openings.

14. The apparatus as defined in claim 1 including master random indicia means for varying the play of the game.

15. The apparatus as defined in claim 1 including means for optionally concealing the images of said arrarys.

16. The apparatus as defined in claim 1 wherein each set of said three manually variable indicators is adjacent another set of three manually variable indicators and the indicators thereof are arranged in adjacent pairs, each said another set of three manually variable indicators having at least three images arranged thereon, and means selectively interconnecting each pair such that movement of one indicator of a pair and the images thereon alters the other indicator of the pair and the images thereon.

17. The apparatus as defined in claim 1 including means for changing the images of each indicator.

18. The apparatus as defined in claim 1 wherein said indicators are each a wheel having a periphery, each wheel periphery carries said images, and means for changing the images of each wheel periphery.

19. The apparatus as defined in claim 1 including means for optionally concealing the images of said arrarys, and said concealing means is a flap mounted for pivotal movement between positions concealing and exposing said images.

* * * * *